US009812135B2

(12) United States Patent
Kamano et al.

(10) Patent No.: US 9,812,135 B2
(45) Date of Patent: *Nov. 7, 2017

(54) DATA EMBEDDING DEVICE, DATA EMBEDDING METHOD, DATA EXTRACTOR DEVICE, AND DATA EXTRACTION METHOD FOR EMBEDDING A BIT STRING IN TARGET DATA

(71) Applicant: FUJITSU LIMITED, Kawasaki-shi, Kanagawa (JP)

(72) Inventors: Akira Kamano, Kawasaki (JP); Yohei Kishi, Kawasaki (JP); Shunsuke Takeuchi, Kawasaki (JP); Masanao Suzuki, Yokohama (JP)

(73) Assignee: FUJITSU LIMITED, Kawasaki (JP)

( * ) Notice: Subject to any disclaimer, the term of this patent is extended or adjusted under 35 U.S.C. 154(b) by 839 days.

This patent is subject to a terminal disclaimer.

(21) Appl. No.: 13/912,674

(22) Filed: Jun. 7, 2013

(65) Prior Publication Data

US 2014/0050324 A1 Feb. 20, 2014

(30) Foreign Application Priority Data

Aug. 14, 2012 (JP) ..... 2012-179966

(51) Int. Cl.
*G10L 19/008* (2013.01)
*G10L 19/018* (2013.01)

(52) U.S. Cl.
CPC ..... *G10L 19/008* (2013.01); *G10L 19/018* (2013.01)

(58) Field of Classification Search
CPC ..... G10L 19/008
USPC ..... 704/500–504
See application file for complete search history.

(56) References Cited

U.S. PATENT DOCUMENTS

| | | | | |
|---|---|---|---|---|
| 5,956,674 | A | 9/1999 | Smyth et al. | |
| 5,974,380 | A | 10/1999 | Smyth et al. | |
| 5,978,762 | A | 11/1999 | Smyth et al. | |
| 8,655,670 | B2 | 2/2014 | Purnhagen et al. | |
| 2004/0078205 | A1* | 4/2004 | Liljeryd | H04B 1/667 704/503 |

(Continued)

FOREIGN PATENT DOCUMENTS

| | | |
|---|---|---|
| JP | 4-51100 | 2/1992 |
| JP | 2000-13800 | 1/2000 |

(Continued)

OTHER PUBLICATIONS

Extended European Search Report dated Oct. 29, 2013 in corresponding International Patent Application No. 13170393.6-1910.

(Continued)

*Primary Examiner* — Michael N Opsasnick
(74) *Attorney, Agent, or Firm* — Staas & Halsey LLP

(57) ABSTRACT

A plurality of candidates of prediction coefficients of a channel signal out of a plurality of channel signals are extracted from a code book storing a plurality of prediction coefficients, each candidate having a predictive error falling within a specific range of predictive error of predictive encoding of two other channel signals, and a prediction coefficient is selected from the extracted candidates as a result of the predictive encoding in accordance with a specific data embedding rule and embedding embed target data into the selected prediction coefficient.

18 Claims, 22 Drawing Sheets

(56) References Cited

U.S. PATENT DOCUMENTS

| | | | | |
|---|---|---|---|---|
| 2006/0047522 | A1* | 3/2006 | Ojanpera | G10L 19/18 704/503 |
| 2006/0140412 | A1 | 6/2006 | Villemoes et al. | |
| 2007/0081597 | A1* | 4/2007 | Disch | H04S 3/008 375/242 |
| 2009/0063164 | A1* | 3/2009 | Wu | G10L 19/0212 704/500 |
| 2011/0173007 | A1* | 7/2011 | Multrus | G10L 19/022 704/500 |
| 2011/0173009 | A1* | 7/2011 | Fuchs | G10L 19/20 704/500 |
| 2011/0224994 | A1 | 9/2011 | Norvell et al. | |
| 2012/0078640 | A1* | 3/2012 | Shirakawa | G10L 19/0212 704/500 |
| 2012/0245947 | A1* | 9/2012 | Neuendorf | G10L 19/20 704/500 |
| 2013/0030819 | A1 | 1/2013 | Purnhagen et al. | |
| 2013/0121411 | A1 | 5/2013 | Robillard et al. | |
| 2014/0278446 | A1* | 9/2014 | Kamano | G10L 19/008 704/500 |

FOREIGN PATENT DOCUMENTS

| | | |
|---|---|---|
| JP | 2002-344726 | 11/2002 |
| JP | 2008-517338 | 5/2008 |
| JP | 2009-213074 | 9/2009 |
| WO | WO 2007/140809 | 12/2007 |

OTHER PUBLICATIONS

"Watermarking Combined with CELP Speech Coding for Authentication", IEICE Transactions on Information and Systems, Information & Systems Society, Tokyo, JP, vol. E88-D, No. 2, Feb. 1, 2005 (Feb. 1, 2005), pp. 330-334, XP002460948, ISSN: 0916-8532, DOI: 10.1093/IETISY/E88-D.2.330.

"Basic Knowledge of Digital Watermark", 1998, pp. 184-194.

Office Action dated Mar. 31, 2016 in related U.S. Appl. No. 14/087,121.

Final Office Action dated Sep. 28, 2016 in related U.S. Appl. No. 14/087,121.

Advisory Action dated Feb. 2, 2017 in related U.S. Appl. No. 14/087,121.

Notice of Allowance dated Mar. 30, 2017 in related U.S. Appl. No. 14/087,121.

* cited by examiner

FIG. 16A

EMBED TARGET DATA

1101010···01010

FIG. 16B 0001 1101010···0101 0100000···

START DATA | EMBED TARGET DATA | END DATA

FIG. 16C 01111110 1101010···01010 0111111001···

START DATA | EMBED TARGET DATA | END DATA

FIG. 20A

ORIGINAL DATA

1101010···

FIG. 20B

ERROR CORRECTION ENCODED DATA

111111000111000111000···

FIG. 20C

EXTRACTED DATA

101110010111000101000···

FIG. 20D

CORRECTED DATA

1101010···

DATA EMBEDDING DEVICE, DATA EMBEDDING METHOD, DATA EXTRACTOR DEVICE, AND DATA EXTRACTION METHOD FOR EMBEDDING A BIT STRING IN TARGET DATA

CROSS-REFERENCE TO RELATED APPLICATION

This application is based upon and claims the benefit of priority of the prior Japanese Patent Application No. 2012-179966, filed on Aug. 14, 2012, the entire contents of which are incorporated herein by reference.

FIELD

The embodiments discussed herein are related to a technique of embedding different information into data, and a technique of extracting the embedded different information.

BACKGROUND

Several encoding techniques to compress an amount of data of multi-channel audio signals are disclosed. One of such techniques is MPEG surround standardized by moving picture experts group (MPEG).

In MPEG surround, audio signals (time signal) of 5.1 channel as an encoding target are time-frequency transformed, and resulting frequency signals are down-mixed to generate 3-channel frequency signals. The 3-channel frequency signals are down-mixed again to calculate 2-channel frequency signals corresponding to stereo signals. The 2-channel frequency signals are then encoded through advanced audio coding (MC) method, and spectral band replication (SBR) coding method. In MPEG surround, spatial information representing spreading of sound or echolocation is calculated in the down-mixing from the 5.1 channels to 3 channels, and in the down-mixing from 3 channels to 2 channels. The spatial information is also encoded together.

In the MPEG surround, stereo signals resulting from down-mixing multi-channel audio signals and the spatial information that is relatively small in data quantity are encoded. The MPEG surround provides a compression rate higher than when channel signals contained in the multi-channel audio signal are independently encoded.

In the MPEG surround, a prediction coefficient is used to encode the spatial information that is calculated in the generation of 2-channel stereo frequency signals. The prediction coefficient is a coefficient that is used to obtain 3-channel signals by up-mixing the 2-channel signals subsequent to the down-mixing. More specifically, the coefficient is used to predict one of the 3-channel signals based on the two other channel signals. The up-mixing is described with reference to FIG. 1.

As illustrated in FIG. 1, the down-mixed 2-channel signals are denoted by an l vector and an r vector. A signal resulting from up-mixing the 2-channel signals is denoted by a c vector. In the MPEG surround, the vector c is predicted using prediction coefficients $c_1$ and $c_2$ in accordance with expression (1):

$$c=c_1l+c_2r \tag{1}$$

Values of a plurality of prediction coefficients are stored on a table referred to as a "code book". The code book is used to increase a use bit rate. In the MPEG surround, each of $c_1$ and $c_2$ takes all values within a range of from −2.0 or larger to +3.0 or smaller in steps of 0.1, namely, combinations of 51×51 are stored on the code book. If the combinations of prediction coefficients are plotted on the orthogonal coordinate system having $c_1$ and $c_2$ as two coordinate axes, 51×51 grid points are obtained as the code book.

A related art technique is available to select a combination of prediction coefficients from the code book. According to the technique, an error defined by a difference between a channel signal prior to predictive encoding and the channel signal subsequent to the predictive encoding is calculated using all combinations of prediction coefficients stored on the code book, and a combination providing a minimum error is selected. Japanese National Publication of International Patent Application No. 2008-517338 discusses a technique of selecting a combination having a minimum error through least square algorithm.

In another related art techniques, additional information is embedded in data. For example, Japanese Laid-open Patent Publication No. 2009-213074 discloses a technique of embedding digital watermark information in encoded data. According to the disclosed technique, compression encoded data is re-encoded using an encoding control parameter different from an encoding control parameter that has been used in the compression encoded data. Japanese Laid-open Patent Publication No. 2000-013800 discloses a technique of hiding encryption information in image data. According to the disclosed technique, a predictive mode signal of predictive image data is corrected in accordance with the encryption information, and encoding is performed in response to a predictive mode signal subsequent to the correction. During decoding, the corresponding encryption information is extracted first from the predictive mode signal.

SUMMARY

In accordance with an aspect of the embodiments, a data embedding device includes a processor; and a memory which stores a plurality of instructions, which when executed by the processor, cause the processor to execute, extracting, from a code book storing a plurality of prediction coefficients, a plurality of candidates of prediction coefficients of a channel signal out of a plurality of channel signals, each candidate having a predictive error falling within a specific range of predictive error of predictive encoding of two other channel signals; and selecting from the extracted candidates a prediction coefficient as a result of the predictive encoding in accordance with a specific data embedding rule and embedding embed target data into the selected prediction coefficient.

The object and advantages of the invention will be realized and attained by means of the elements and combinations particularly pointed out in the claims. It is to be understood that both the foregoing general description and the following detailed description are exemplary and explanatory and are not restrictive of the invention, as claimed.

BRIEF DESCRIPTION OF DRAWINGS

These and/or other aspects and advantages will become apparent and more readily appreciated from the following description of the embodiments, taken in conjunction with the accompanying drawing of which:

FIGS. 16A through 16C illustrate a first technique of embedding additional data;

FIG. 20A through 20D illustrate an example of an error correction encoding process performed on embed target data.

DESCRIPTION OF EMBODIMENTS

A data embedding device, a data embedding method, a data extractor device, and a data extraction method are described as embodiments below with reference to the drawings. The embodiments discussed herein are not intended to limit the technique disclosed herein.

Figure 2A:
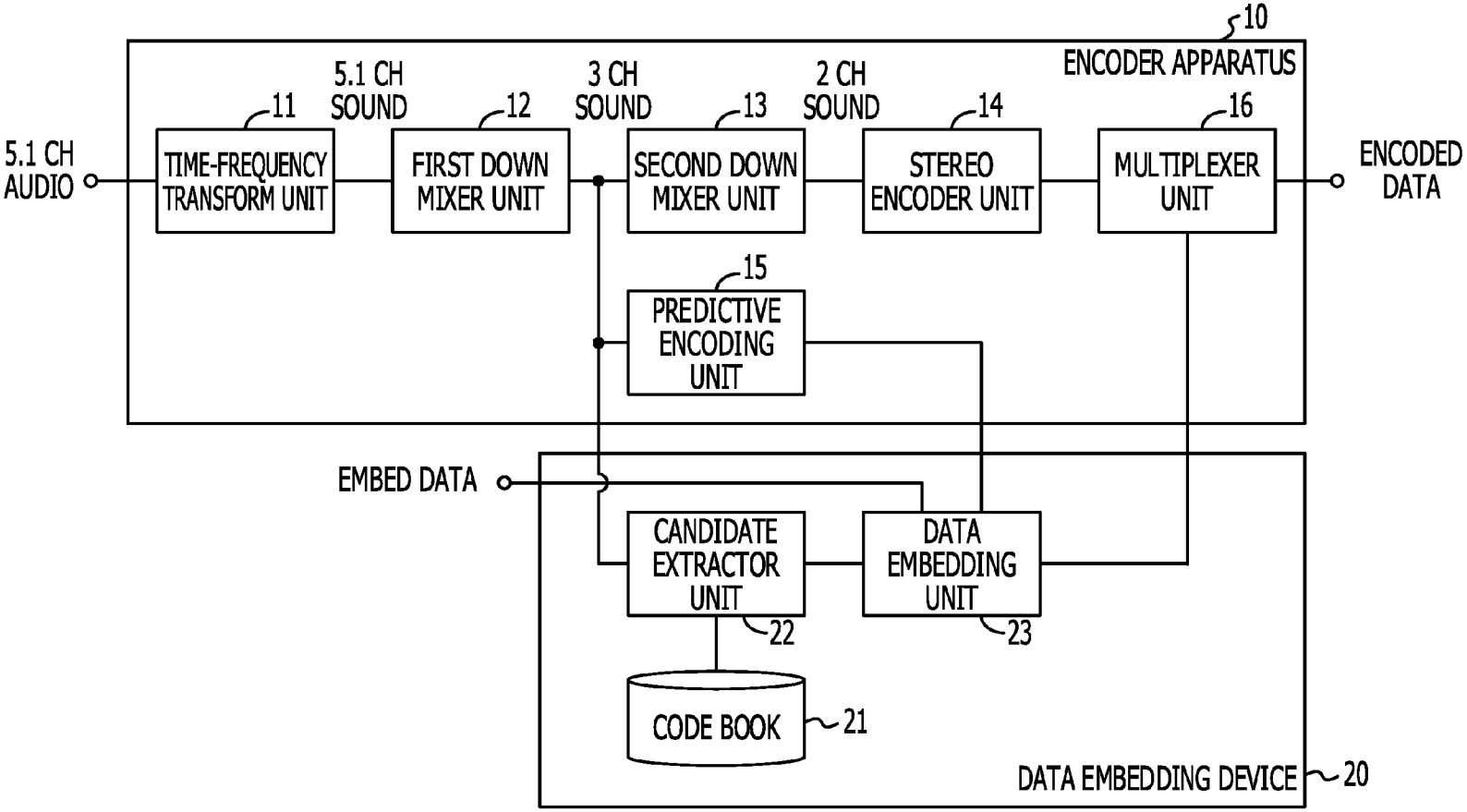
FIG. 2A is a block diagram illustrating a structure of an encoding system.
Figure 2B:
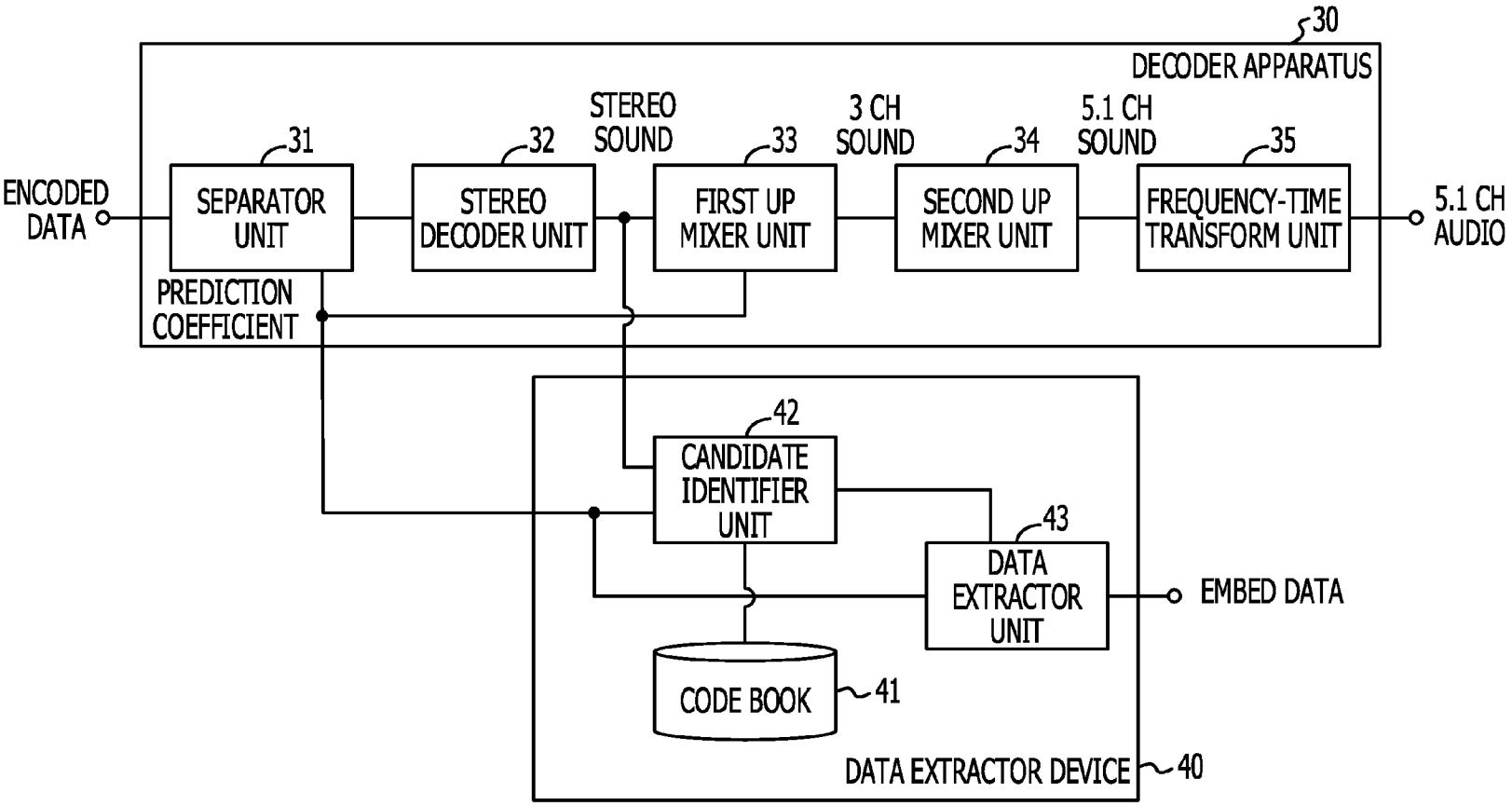
FIG. 2B is a block diagram illustrating a structure of a decoding system.

Referring to FIGS. 2A and 2B, FIG. 2A is a function block diagram illustrating a structure of an encoding system including a data embedding device as an embodiment, and FIG. 2B is a function block diagram illustrating a structure of a decoding system including a data extractor device as an embodiment.

Elements included in the encoding system and the decoding system of FIGS. 2A and 2B are implemented as separate circuits. Part or whole of the elements may be integrated as integrated circuits respectively forming the encoding system and the decoding system. The elements may be functional modules implemented by programs running on central processing units on the encoding system and decoding systems.

The encoding system of FIG. 2A includes an encoder apparatus 10 and a data embedding device 20. The encoder apparatus 10 receives 5.1 channel audio signals in a time domain. The 5.1 channel audio signals include 5 channel signals of left front, center, right front, left surround, and right surround and 0.1 channel of subwoofer. The encoder apparatus 10 encodes the 5.1 channel audio signals, thereby outputting encoded data. The data embedding device 20 embeds additional data into the encoded data output by the encoder apparatus 10, and then inputs to the data embedding device 20 data that is to be embedded in the encoded data. The encoding system of FIG. 2A provides from the encoder apparatus 10 an output that is the encoded data having embed target data embedded therewithin.

The decoding system of FIG. 2B includes a decoder apparatus 30 and a data extractor device 40. The decoder apparatus 30 receives the encoded data as the output from the encoding system of FIG. 2A, restores the original 5.1 channel audio signals in the time domain from the encoded data, and then outputs the 5.1 channel audio signals. The data extractor device 40 extracts from the encoded data the data embedded by the data embedding device 20, and then outputs the embedded data.

The encoding system of FIG. 2A is described below. The encoder apparatus 10 includes a time-frequency transform unit 11, a first down mixer unit 12, a second down mixer unit 13, a stereo encoder unit 14, a predictive encoding unit 15, and a multiplexer unit 16.

The time-frequency transform unit 11 transforms the 5.1 channel audio signals in the time domain input from the encoder apparatus 10 into 5.1 channel frequency signals. In the embodiment, the time-frequency transform unit 11 performs time-frequency transform on a per frame unit basis through quadrature mirror filter (QMF). This transform results in a frequency component signal in each band segment of the input audio signal in the time domain when one channel audio frequency band is equally divided (by 64). The process of each function block of the encoder apparatus 10 and the data embedding device 20 in the encoding system of FIG. 2A is performed on each frequency component signal of each band.

The first down mixer unit 12 down mixes the frequency signal of each channel each time the 5.1 channel frequency signals are received. The first down mixer unit 12 thus generates 3-channel frequency signals inclusive of left, center, and right signals.

The second down mixer unit 13 down mixes the frequency signal of each channel each time the 3-channel frequency signals are received from the first down mixer unit 12. The second down mixer unit 13 thus generates 2 channel stereo frequency signals inclusive of left and right signal.

The stereo encoder unit 14 encodes the stereo frequency signals received from the second down mixer unit 13 in accordance with the MC encoding method or the SBR encoding method.

The predictive encoding unit 15 determines a value of the prediction coefficient. The prediction coefficient is used in a prediction operation in the up mixing that restores the 3 channel signals from the stereo signals as an output from the second down mixer unit 13. The up mixing to restore the 3 channel signals from the stereo frequency signals is to be performed by a first up mixer unit 33 in a decoder apparatus 30 described below in accordance with the method described with reference to FIG. 1.

The multiplexer unit 16 arranges the prediction coefficient and the encoded data output from the stereo encoder unit 14 in a specific order to multiplex the prediction coefficient and the encoded data. The multiplexer unit 16 then outputs the multiplexed encoded data. If the encoder apparatus 10 is operated in a standalone fashion, the multiplexer unit 16 multiplexes the prediction coefficient output from the predictive encoding unit 15 and the encoded data. If the encoding system configured as illustrated in FIG. 2A is used, the multiplexer unit 16 multiplexes the prediction coefficient output from the data embedding device 20 with the encoded data.

The data embedding device 20 includes a code book 21, a candidate extractor unit 22, and a data embedding unit 23.

The code book 21 stores a plurality of prediction coefficients. The code book 21 is the same as the one that the predictive encoding unit 15 in the encoder apparatus 10 uses to obtain the prediction coefficient. As illustrated in FIG. 2A, the data embedding device 20 includes the code book 21. Alternatively, the code book 21 may be a code book included in the predictive encoding unit 15 in the encoder apparatus 10.

With respect to one channel signal of a plurality of channel signals, the candidate extractor unit 22 extracts from the code book 21 a plurality of candidates of prediction coefficients of a channel signal out of a plurality of channel signals, each candidate having a predictive error falling within a specific range of predictive error of predictive encoding of two other channel signals. More specifically, the candidate extractor unit 22 extracts from the code book 21 the plurality of candidates of prediction coefficients, each candidate having an error from the prediction coefficient obtained by the predictive encoding unit 15 falling within a specific threshold value.

The data embedding unit 23 selects from the candidates extracted by the candidate extractor unit 22 the prediction coefficient as a result of the predictive encoding in accordance with a specific data embedding rule, and then embeds embed target data in the prediction coefficient. More specifically, the data embedding unit 23 selects the prediction coefficient to be input to the multiplexer unit 16 from among the candidates extracted by the candidate extractor unit 22 in accordance with the specific data embedding rule, and then embeds the embed target data in the prediction coefficient.

The decoding system of FIG. 2B is described below. The decoder apparatus 30 includes a separator unit 31, a stereo decoder unit 32, a first up mixer unit 33, a second up mixer unit 34, and a frequency-time transform unit 35.

In accordance with the order of arrangement in the multiplexing used by the multiplexer unit 16, the separator unit 31 separates the encoded data output from the stereo encoder unit 14 and the prediction coefficient from the multiplexed encoded data which is the output of the encoding system of FIG. 2A.

The stereo decoder unit 32 decodes the encoded data received from the separator unit 31, thereby restoring two channel stereo frequency signals inclusive of left and right signals.

Figure 1:
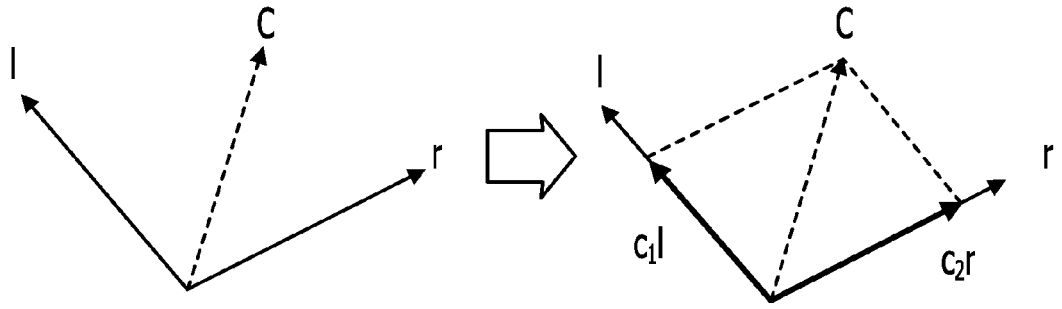
FIG. 1 illustrates an up mixing operation from 2 channels to 3 channels.

The first up mixer unit 33 up mixes the stereo frequency signals received from the stereo decoder unit 32 in accordance with the up mixing method of FIG. 1 using the prediction coefficient received from the separator unit 31. The first up mixer unit 33 thus restores 3-channel frequency signals inclusive left, center and right signals.

The second up mixer unit 34 up mixes the 3-channel frequency signals received from the first up mixer unit 33. The second up mixer unit 34 thus restores the 5.1 channel frequency signals inclusive of front left, center, front right, left surround, right surround, and subwoofer signals.

The frequency-time transform unit 35 performs frequency-time transform, which is inverse to the time-frequency transform performed by the time-frequency transform unit 11, on the 5.1 channel frequency signals received from the second up mixer unit 34. The frequency-time transform unit 35 thus restores and outputs 5.1 channel audio signals in the time domain.

The data extractor device 40 includes a code book 41, a candidate identifier unit 42, and a data extractor unit 43.

The code book 41 stores a plurality of candidates of prediction coefficients in advance. The code book 41 is the same as the code book 21 included in the data embedding device 20. As illustrated in FIG. 2B, the data extractor device 40 includes the code book 41. Alternatively, the data extractor device 40 may share a code book that the decoder apparatus 30 includes to obtain the prediction coefficient to be used by the first up mixer unit 33.

The candidate identifier unit 42 references the code book 41 and identifies a candidate of the prediction coefficient extracted by the candidate extractor unit 22, in accordance with the prediction coefficient as a result of the predictive encoding and the two other channel signals. More specifically, the candidate identifier unit 42 references the code book 41 and identifies the candidate of the prediction coefficient extracted by the candidate extractor unit 22, in accordance with the prediction coefficient received from the separator unit 31, and the stereo frequency signals restored by the stereo decoder unit 32.

The data extractor unit 43 extracts the data that the data embedding unit 23 has embedded in the encoded data from the candidates of the prediction coefficients identified by the candidate identifier unit 42, in accordance with the data embedding rule used by the data embedding unit 23 in the data embedding.

The data embedding device 20 thus constructed embeds the additional data in the encoded data and then the data extractor device 40 extracts the additional data from the encoded data. Any of the candidates of the prediction coefficients to be selected in the data embedding of the data embedding device 20 falls within a specific range of predictive error in the predictive encoding that is performed using the selected parameter. If the specific range of the predictive error is set to be sufficiently narrow, degradation in the information restored through the predictive encoding for the up mixing of the first up mixer unit 33 in the decoder apparatus 30 is unrecognizable.

The data embedding device 20 and the data extractor device 40 may be implemented using a computer having a standard computer structure.

Figure 3:
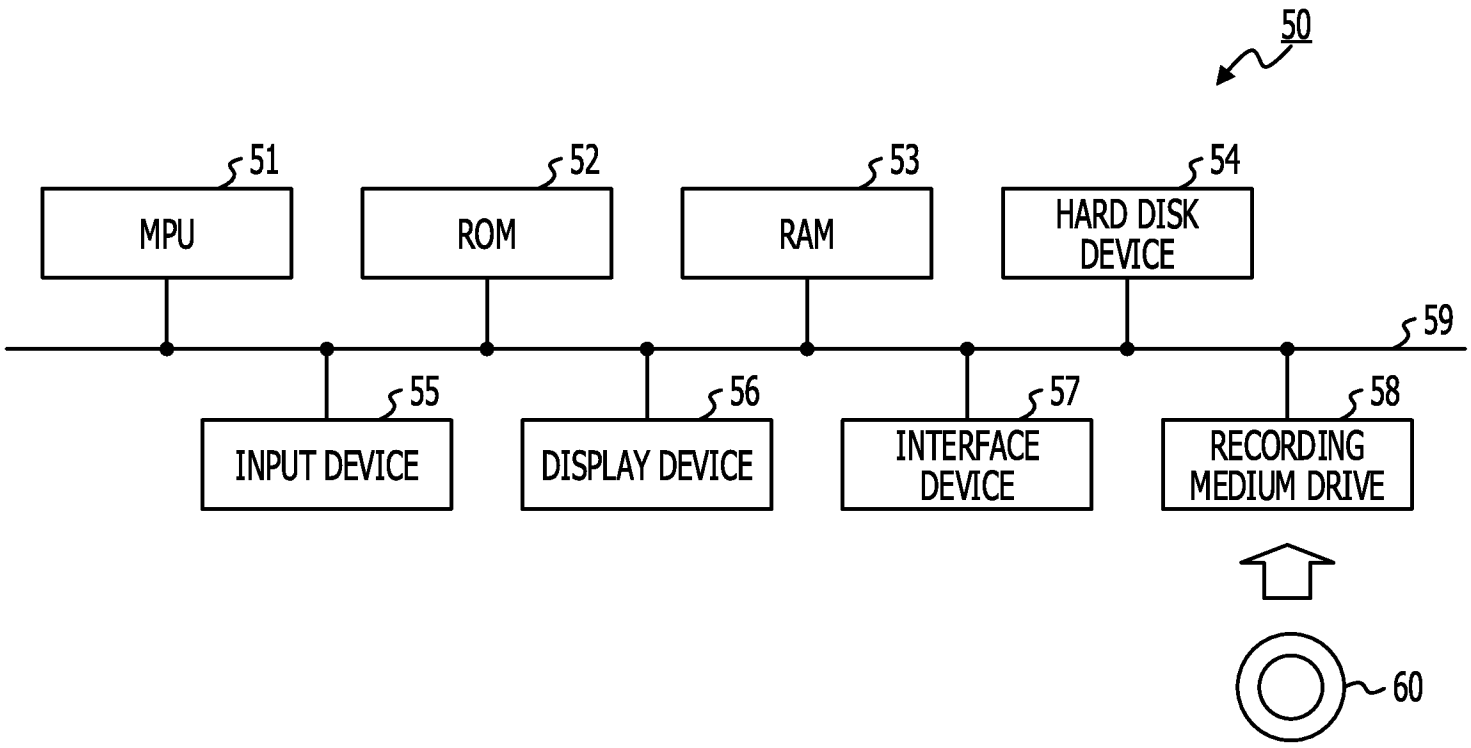
FIG. 3 is a block diagram illustrating a structure of a computer.

FIG. 3 illustrates the structure of the computer 50 that may function as the data embedding device 20 and the data extractor device 40.

The computer 50 includes a micro processing unit (MPU) 51, a read-only memory (ROM) 52, a random-access memory (RAM) 53, a hard disk drive 54, an input device 55, a display device 56, an interface device 57, and a recording medium drive 58. These elements are interconnected via a bus line 59, and transmit and receive a variety of data under the control of the MPU 51.

The MPU 51 is an arithmetic processor unit that generally controls the computer 50.

The ROM 52 is a read-only semiconductor memory that stores a specific basic control program in advance. The MPU 51 reads and executes the basic control program at the startup of the computer 50, and controls an operation of each element in the computer 50.

The RAM 53 is a readable and writable semiconductor memory, and serves as a working memory area as appropriate when the MPU 51 performs a variety of control programs.

The hard disk drive 54 is a storage device that stores the variety of control programs to be executed by the MPU 51 and a variety of data. The MPU 51 reads a specific control program stored on the hard disk drive 54 and then executes the specific control program, thereby performing a control process to be discussed later. The code books 21 and 41 may be stored on the hard disk drive 54 in advance, for example. In order to cause the computer 50 to operate as the data embedding device 20 and the data extractor device 40, the MPU 51 is first caused to perform a process of reading the code books 21 and 41 from the hard disk drive 54 and of storing the code books 21 and 41 onto the RAM 53.

The input device 55 includes a keyboard and a mouse. The input device 55, if operated by a user of the computer 50, acquires an input of a variety of information from the user associated with an operation action, and sends the acquired input information to the MPU 51. For example, the input device 55 acquires data that is to be embedded in the encoded data.

The display device 56 is a liquid-crystal display, for example, and displays a variety of text and images in response to display data sent from the MPU 51.

The interface device 57 manages exchange of a variety of data with various devices connected to the computer 50. For example, the interface device 57 exchanges data including encoded data and prediction coefficients with each of the encoder apparatus 10 and the decoder apparatus 30.

The recording medium drive 58 reads a variety of control programs and data stored on a removable recording medium 60. The MPU 51 reads a specific control program stored on the removable recording medium 60 via the recording medium drive 58 and then executes the specific control program, thereby performing a variety of control processes to be discussed later. The removable recording media 60 include a compact disk read-only memory (CD-ROM), a digital versatile disk read-only memory (DVD-ROM), and a flash memory having a universal serial bus (USB) connector.

The control program that causes the MPU 51 to execute the control process and process steps discussed below is generated in order to cause the computer 50 to function as the data embedding device 20 and the data extractor device 40. The generated control program is stored on the hard disk drive 54 or the removable recording medium 60 in advance. A specific instruction is given to the MPU 51 to cause the MPU 51 to read and execute the control program. In this way, the MPU 51 functions as the elements included in the data embedding device 20 and the decoder apparatus 30 respectively discussed with reference to FIGS. 2A and 2B. The computer 50 thus functions as the data embedding device 20 and the data extractor device 40.

Figure 4:
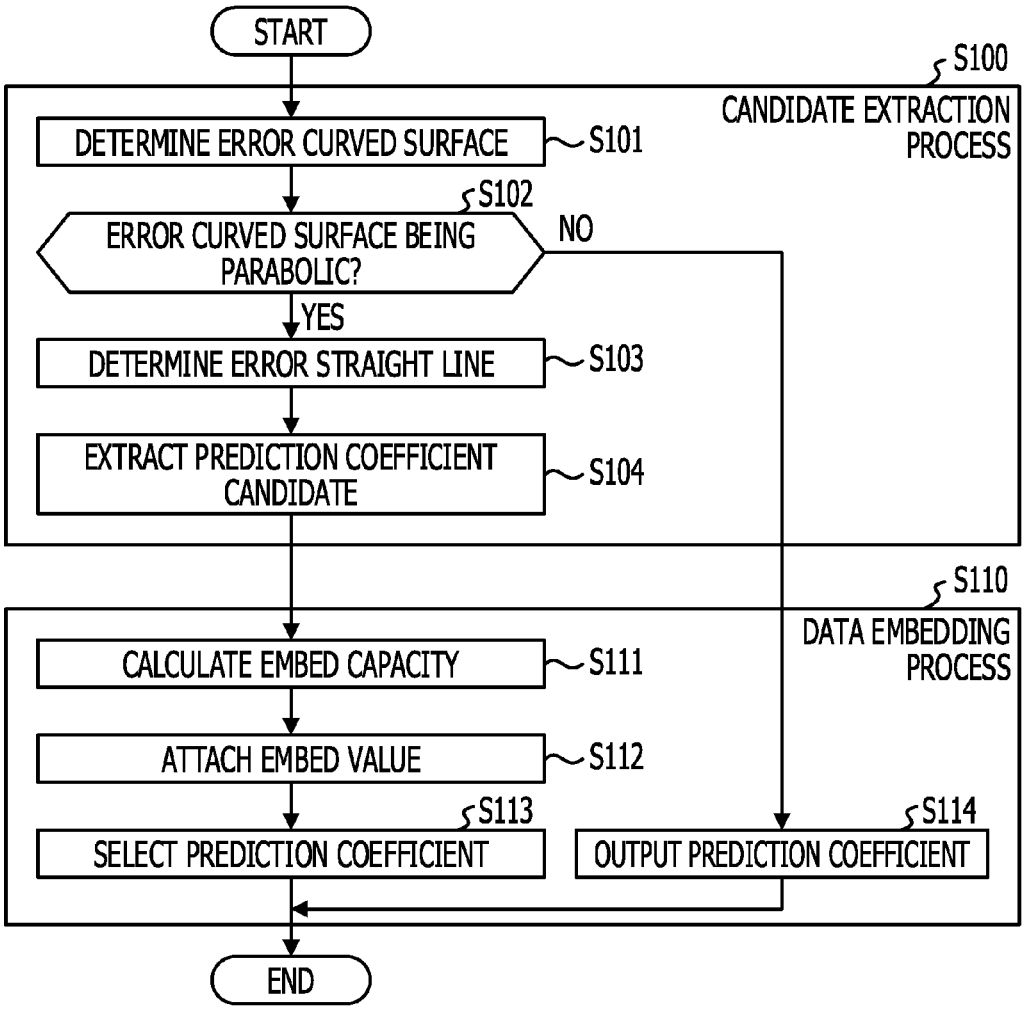
FIG. 4 is a flowchart illustrating a control process performed by a data embedding device.

The control process performed by the data embedding device 20 is described with reference to FIG. 4. FIG. 4 is a flowchart illustrating the control process. As illustrated in FIG. 4, the candidate extractor unit 22 performs a candidate extraction process in S100. Through the candidate extraction process, the candidate extractor unit 22 extracts from the code book 21 a plurality of candidates of prediction coefficients, each candidate having an error with the prediction coefficient obtained by the predictive encoding unit 15 in the encoder apparatus 10 falling within a specific threshold value. The candidate extraction process is described further in detail.

In S101, the candidate extractor unit 22 performs an error curved surface determination operation. The error curved surface determination operation is performed to determine a surface shape of the error curved surface.

The error curved surface is described. The error curved surface is obtained by representing in graph a distribution of an error (predictive error) between a predictive result based on the prediction coefficient of a signal of one of the plurality of channels and an actual signal of the one channel, with the prediction coefficient varied. In the embodiment, the predictive error is obtained when the signal of a center channel is predicted using the prediction coefficients as illustrated in FIG. 1 and then the curved surface is obtained by representing the distribution of the predictive error in graph with the prediction coefficients varied.

Figure 5A:
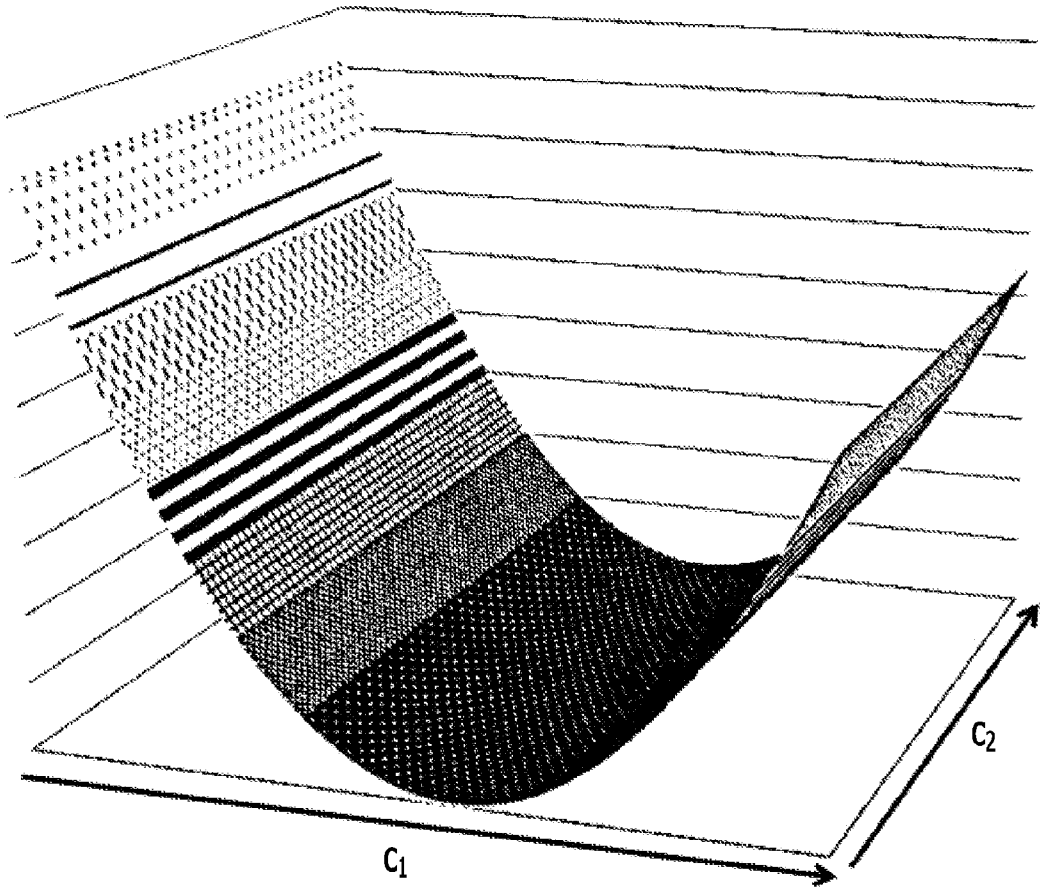
FIG. 5A illustrates an example of a parabolic error curved surface.
Figure 5B:
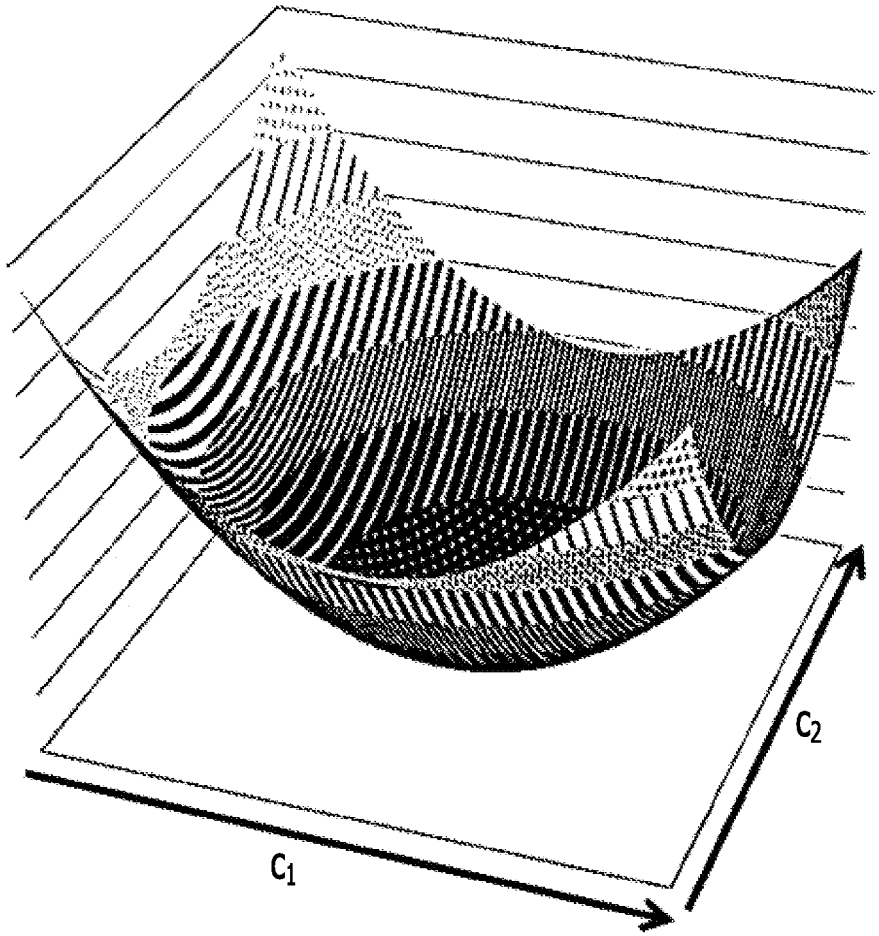
FIG. 5B illustrates an example of an ellipsoidal error curved surface.

FIGS. 5A and 5B illustrate examples of error curved surfaces. FIG. 5A illustrates a parabolic error curved surface, and FIG. 5B illustrates an ellipsoidal error curved surface. FIGS. 5A and 5B illustrate the error curved surfaces drawn in a three-dimensional orthogonal coordinate system. Arrows $c_1$ and $c_2$ respectively represent values in magnitude of the prediction coefficients of a left channel and a right channel. A length in a direction perpendicular to a plane including the arrows $c_1$ and $c_2$ (upward direction in the page of FIG. 5A) represents the magnitude of the predictive error. In any plane parallel to the plane including the arrows $c_1$ and $c_2$, the predictive error remains the same regardless of whether any combination of the values of the prediction coefficients is selected to predict the signal of the center channel.

Let $c_0$ represent a signal vector of an actual signal of the center channel, and c represent a signal vector as a predictive result of the signal of the center channel using the signals of the left channel and the right channel and the prediction coefficient, and a predictive error d is expressed by the following expression (2).

$$d=\Sigma|c_0-c|^2=\Sigma|c_0-(c_1l+c_2r)|^2 \tag{2}$$

where l and r represent signal vectors of the left channel and the right channel, respectively, and $c_1$ and $c_2$ represent prediction coefficients of the left channel and the right channel, respectively.

If expression (2) is modified in terms of $c_1$ and $c_2$, the following equation (3) results:

$$c_1 = \frac{f(l,r)f(r,c) - f(l,c)f(r,r)}{f(l,r)f(l,r) - f(l,l)f(r,r)} \tag{3}$$

$$c_2 = \frac{f(l,c)f(l,r) - f(l,l)f(r,c)}{f(l,r)f(l,r) - f(l,l)f(r,r)}$$

where function f expresses an inner product of vectors.

The denominator of the right side of expression (3), namely, expression (4) is considered;

$$f(l,r)f(\mathbf{1},r)-f(l,l)f(r,r) \tag{4}$$

If the value of expression (4) is zero, the surface shape of the error curved surface becomes parabolic as in FIG. 5A. If the value of expression (4) is not zero, the surface shape of the error curved surface becomes ellipsoidal as in FIG. 5B. In the error curved surface determination operation in S101 of FIG. 4, the candidate extractor unit 22 determines the inner product of the signal vectors of the left channel and the right channel output from the first down mixer unit 12 to calculate the value of expression (4). Depending on whether the value of expression (4) is zero or not, the candidate extractor unit 22 determines the surface shape of the error curved surface.

The zero value of expression (4) is limited to one of the following three cases: (1) if the r vector is a zero vector, (2)

if the l vector is a zero vector, and (3) if the l vector is a constant number multiple of the r vector. In the error curved surface determination operation in S101, the candidate extractor unit 22 may determine the surface shape of the error curved surface by examining which case the signals of the left channel and the right channel output from the first down mixer unit 12 applies to.

In S102, the candidate extractor unit 22 determines whether the surface shape of the error curved surface determined in the error curved surface determination operation in S101 is parabolic or not. If the surface shape of the error curved surface determined in the error curved surface determination operation in S101 is parabolic (yes branch from S102), the candidate extractor unit 22 proceeds to S103. The candidate extractor unit 22 then performs an operation to embed data. On the other hand, if the surface shape of the error curved surface determined in the error curved surface determination operation in S101 is not parabolic (ellipsoidal) (no branch from S102), processing proceeds to S114. In such a case, the data embedding is not performed.

In S103, the candidate extractor unit 22 performs an error straight line determination operation. An error straight line is a set of points, each point having a minimum predictive error on the error curved surface. If the error curved surface is parabolic, the sets of points becomes a straight line. If the error curved surface is ellipsoidal, the set of points is not a straight line, but a single point. The determination operation in S102 is thus a determination operation as to whether the set of points is a straight line or not.

In the parabolic error curved surface of FIG. 5A, a tangent line where the error curved surface is tangent to the plane including the prediction coefficients $c_1$ and $c_2$ is an error straight line. If any combination of the prediction coefficients $c_1$ and $c_2$ identified by a point on the error straight line is used in the prediction of the signal of the center channel, the predictive errors remain the same.

The error straight line may be expressed as one of the following three expressions depending on the signal levels of the left and right channels. In the error straight line determination operation in S103, the candidate extractor unit 22 determines the error straight line by substituting the signals of the left and right channels output from the first down mixer unit 12 for each signal vector on the right side of each of the following equations.

First, if the r vector is zero, in other words, there is no signal on the right channel, the expression of the error straight line becomes the following expression (5):

$$c_1 = \frac{f(r, c)}{f(r, r)} \tag{5}$$

Figure 6:
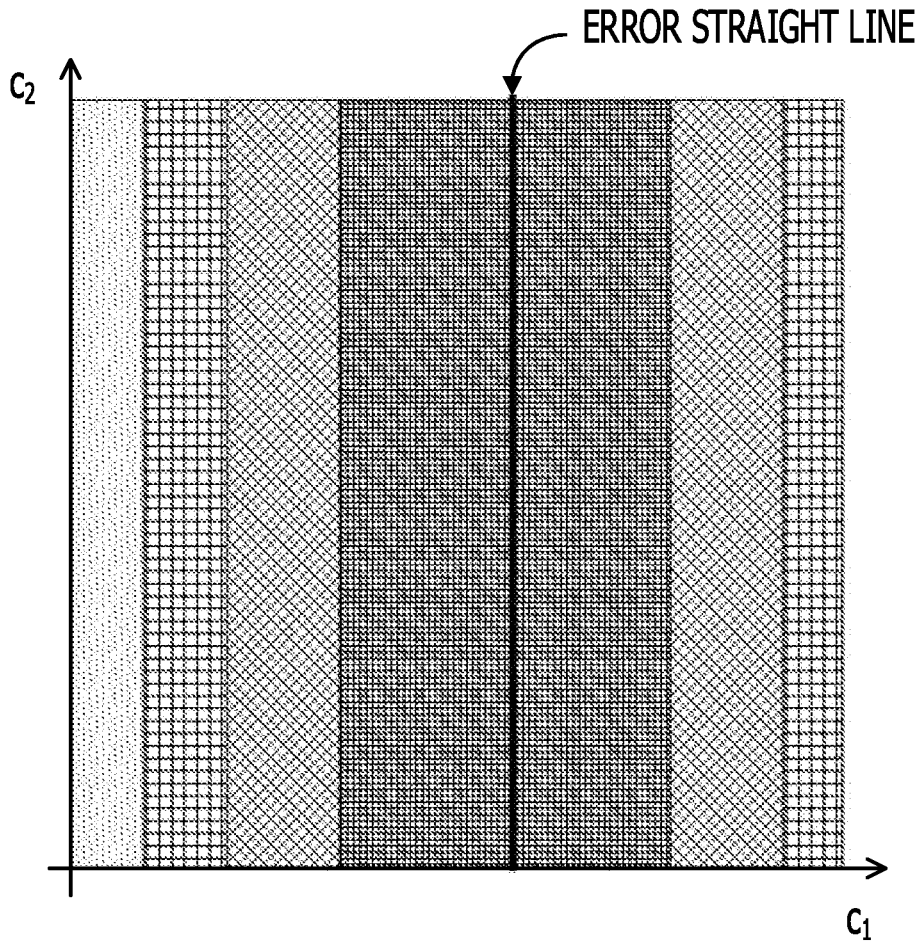
FIG. 6 illustrates an error straight line drawn on a projection view of the error curved surface of FIG. 5A.

FIG. 6 illustrates a straight line expressed by expression (5) drawn on a view of the error curved surface of FIG. 5A projected on the plane including the arrows $c_1$ and $c_2$.

If the l vector is zero, in other words, there is no signal on the left channel, the expression of the error straight line becomes the following expression (6):

$$c_2 = \frac{f(l, c)}{f(l, l)} \tag{6}$$

If the l vector is a constant number multiple of the r vector, in other words, the ratio of the l vector to the r vector is constant on all samples in a process target frame, the expression of the error straight line becomes the following expression (7):

$$c_2 = -\frac{l}{r}c_1 + \frac{l}{r}\frac{f(l, c)}{f(l, l)} \tag{7}$$

If both the r vector and the l vector are zero vectors, in other words, the signals on both the R and L channels are zeros, a set of points, each having a minimum predictive error, do not become a straight line. The candidate extractor unit 22 proceeds to S104 without determining the error straight line in the error straight line determination operation in S103. This operation is described below.

In S104, the candidate extractor unit 22 performs a prediction coefficient candidate extraction operation. In the prediction coefficient candidate extraction operation, the candidate extractor unit 22 extracts the prediction coefficients from the code book 21 in accordance with the error straight line determined in S103.

In the prediction coefficient candidate extraction operation, the candidate extractor unit 22 extracts candidates of prediction coefficients in accordance with the positional relationship of the error straight line in the plane including the prediction coefficients $c_1$ and $c_2$ with each point corresponding to the prediction coefficients stored on the code book 21. In the prediction coefficient candidate extraction operation, the positional relationship is that any point is selected as long as the distance of the point corresponding to the candidate of the prediction coefficient stored on the code book 21 to the error straight line falls within a specific range. A combination of the prediction coefficients represented by the selected points is extracted as the candidates of prediction coefficients. This operation is specifically described with reference to FIG. 7.

Figure 7:
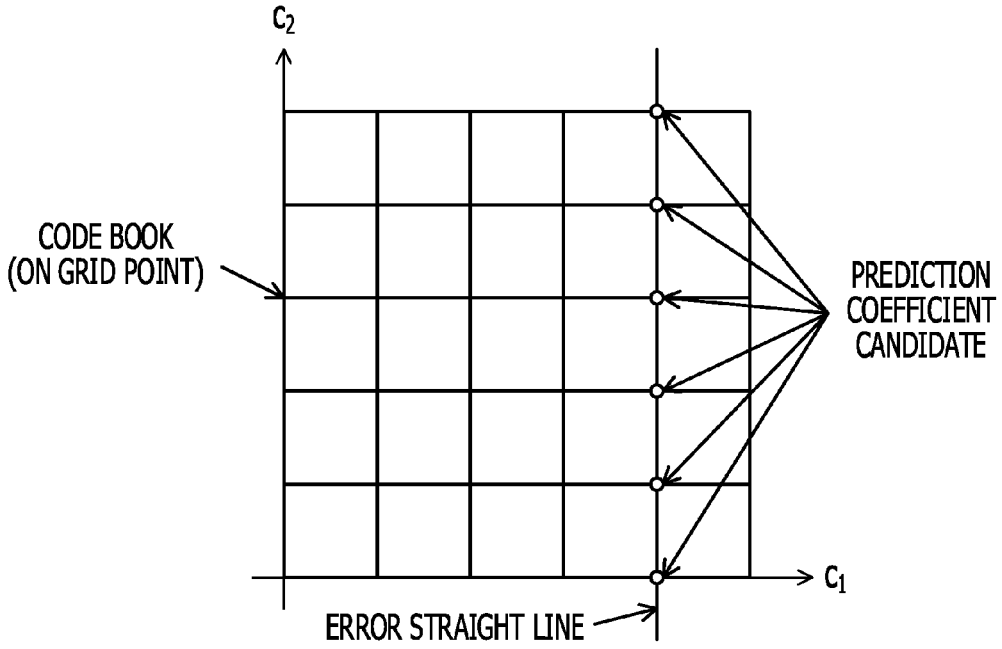
FIG. 7 illustrates a prediction coefficient candidate extraction process of a pattern A.

As illustrated in FIG. 7, points corresponding to the prediction coefficients stored on the code book 21 are arranged on two-dimensional orthogonal coordinates defined by the prediction coefficients $c_1$ and $c_2$. These points are arranged as grid points. Some of the points are present right on the error straight line. As illustrated in FIG. 7, points present on the error straight line out of the grid points are denoted by blank circles. Among the grid points, the plurality of points denoted by the blank circles have the same minimum distance (in other words, zero) to the error straight line. If any of the combinations of the prediction coefficients $c_1$ and $c_2$ represented by these points is used to predict the signal of the center channel, the predictive error becomes the same and minimum. As illustrated in FIG. 7, the combinations of the prediction coefficients $c_1$ and $c_2$ denoted by the blank circles are extracted from the code book 21 as the candidates of prediction coefficients.

In the prediction coefficient candidate extraction operation, several extraction patterns of extracting the candidates of prediction coefficients are prepared. An extraction pattern is selected in accordance with the positional relationship between the error straight line on the plane and the corresponding points of the prediction coefficients on the code book 21, and then the prediction coefficients are extracted. The selection of the extraction pattern is described below.

The candidate extractor unit 22 performs the operations in S101 through S104 in the candidate extraction process in S100. When the candidate extractor unit 22 completes the candidate extraction process in S100, the data embedding unit 23 performs a data embedding process in S110. In the data embedding process, the data embedding unit 23 selects the prediction coefficient as a result of the predictive encoding of the predictive encoding unit 15 from the candidates extracted in S104, in accordance with a specific data embedding rule, and then embeds embed target data in the prediction coefficient. The data embedding process is described in detail below.

In S111, the data embedding unit 23 performs an embed capacity calculation operation. In the embed capacity calculation operation in S104, the data embedding unit 23 calculates, as a data capacity that allows embedding, a maximum bit count that does not exceed the number of candidates of prediction coefficients extracted in the prediction coefficient candidate extraction operation in S104. For example, FIG. 7 illustrates six blank circles to be extracted as the candidates of prediction coefficients, and at least a value 4, that is, 2 bit data may be embedded. In the embed capacity calculation operation in S111, "2 bits" are obtained as a result of the calculation.

In S112, the data embedding unit 23 performs an embed value attachment operation. In the embed value attachment operation, the data embedding unit 23 attaches an embed value to each of the candidates of prediction coefficients extracted in the prediction coefficient candidate extraction operation in S104, in accordance with a specific rule. In S113, the data embedding unit 23 performs a prediction coefficient selection operation. In the prediction coefficient selection operation, the data embedding unit 23 references a bit string of the embed target data equal to the embed capacity, selects a candidate of prediction coefficient having an embed value matching the value of the bit string, and outputs the selected candidates to the multiplexer unit 16 in the encoder apparatus 10.

Figure 8:
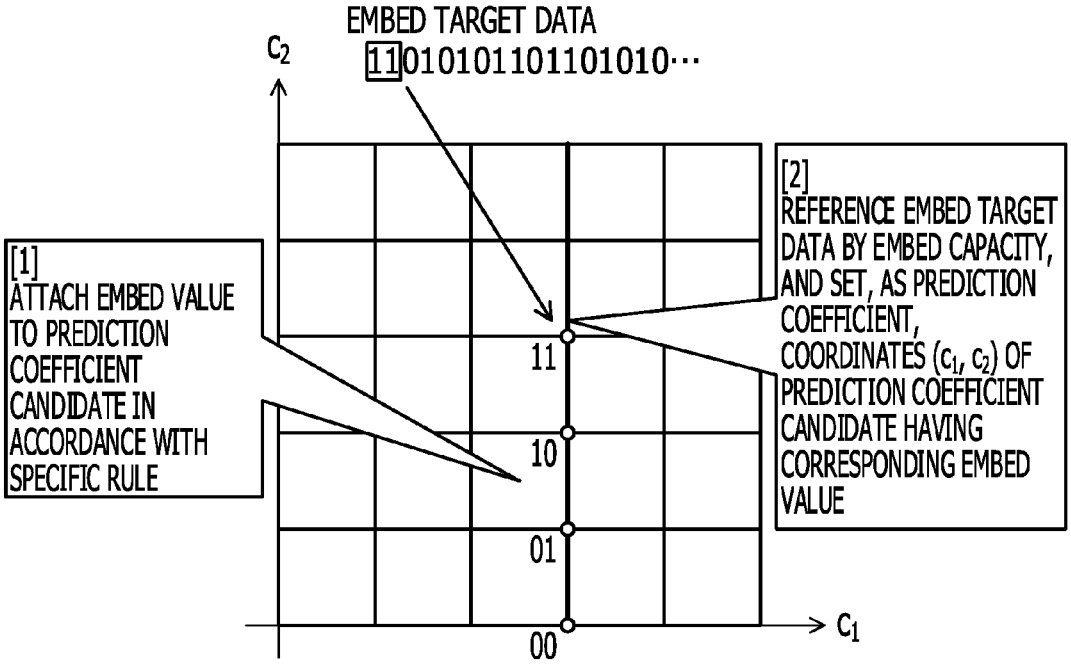
FIG. 8 illustrates a data embedding process.

The operations in S112 through S113 are specifically described with reference to FIG. 8. For example, the candidates of the prediction coefficients may now be extracted as illustrated in FIG. 7. The embed value attachment rule may be that the prediction coefficient $c_2$ is to be attached in the order from small to large values. As illustrated in FIG. 8, embed values "00", "01", "10", and "11" are attached in the order of from small to large values to the prediction coefficient $c_2$.

The embed target data may be "11010101101101 010 . . . " as illustrated in FIG. 8. A bit string of the first 2 bits "11" of the embed target data may be embedded in the prediction coefficient. A combination of the prediction coefficients $c_1$ and $c_2$ corresponding to a blank circle having the embed value "11" attached thereto is selected and output to the multiplexer unit 16 as illustrated in FIG. 8.

When the prediction coefficient selection operation in S113 is complete, the control process of FIG. 4 ends. On the other hand, if the candidate extractor unit 22 determines that the surface shape of the error curved surface determined in the error curved surface determination operation in S102 is not parabolic (ellipsoidal), the data embedding unit 23 performs an operation in S114. Through the operation in S114, the data embedding unit 23 outputs a combination of the values of the prediction coefficients $c_1$ and $c_2$ output by the predictive encoding unit 15 directly to the multiplexer unit 16, and then multiplexes the combination with the encoded data. In this case, no data embedding is performed. When the operation in S114 is complete, the control process of FIG. 4 ends.

The data embedding device 20 thus performs the control process, thereby embedding the additional data in the encoded data generated by the encoder apparatus 10.

Simulation results of a size of data that may be embedded through the above control process is described below. Used in this simulation are 12 types of 5.1 channel audio signals (including voice and music) of one minute of MPEG surround with a sampling frequency of 48 kHz, and a transfer rate of 160 kb/s.

In this simulation, an average number of parameters per second is 1312, the probability of the parabolic surface shape of the error curved surface is 5%, and an average embed capacity to the prediction coefficient is 5 bits. As a result, the embed capacity is 320 kb/s, and in terms of one-minute audio signal, data of 2.4 kilobytes may be embedded.

Figure 9:
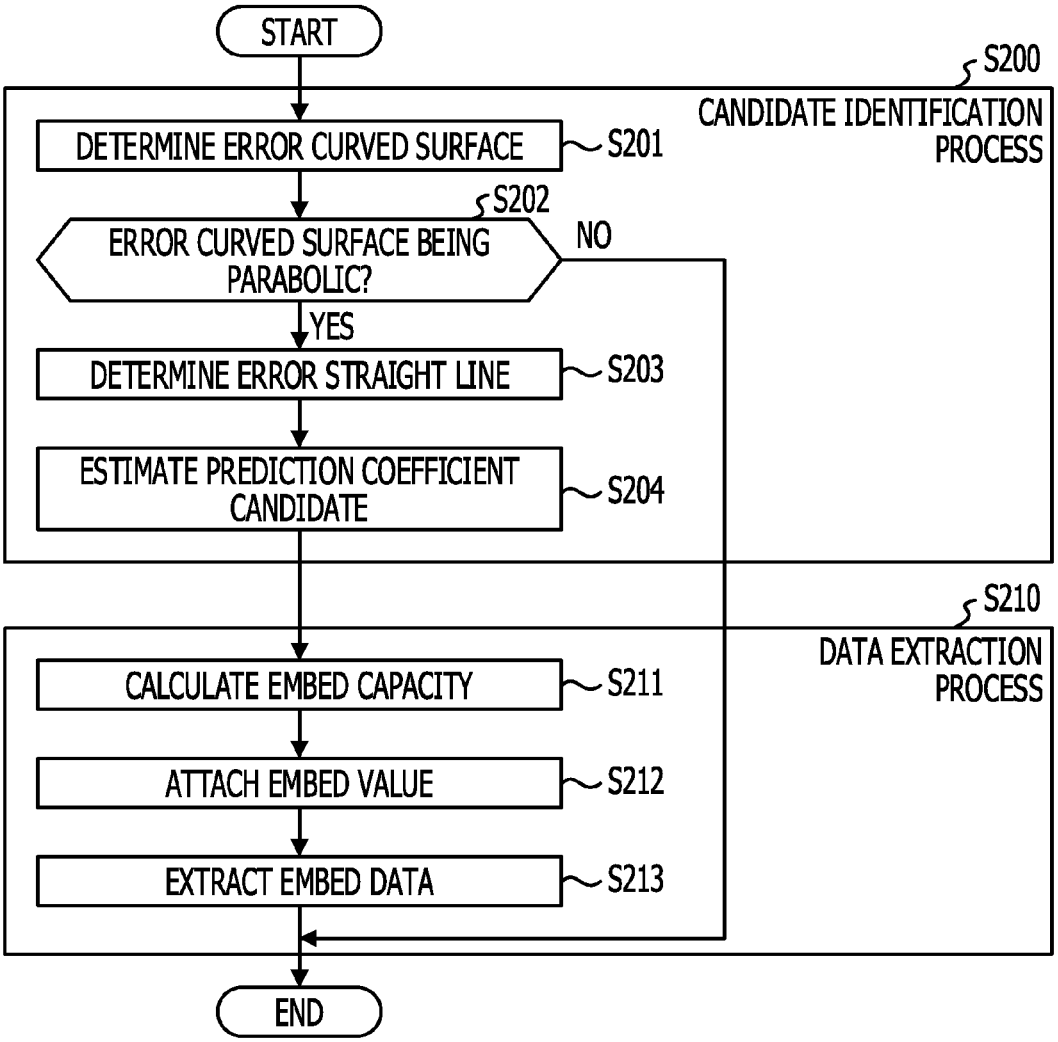
FIG. 9 is a flowchart illustrating a control process performed by a data extraction device.

The control process performed by the data extractor device 40 of FIG. 2B is described with reference to FIG. 9. FIG. 9 is a flowchart illustrating the control process.

In S200 of FIG. 9, the candidate identifier unit 42 performs a candidate identification process. In the candidate identification process, the candidate identifier unit 42 identifies from the code book 41 the candidate of prediction coefficient extracted by the candidate extractor unit 22, in accordance with the prediction coefficient received from the separator unit 31 and the stereo frequency signal restored by the stereo decoder unit 32. The candidate identification process is described further in detail below.

In S201, the candidate identifier unit 42 performs an error curved surface determination operation. The error curved surface determination operation is performed to determine the surface shape of the error curved surface, and is the same operation as the error curved surface determination operation performed by the candidate extractor unit 22 in S101 of FIG. 4. In the error curved surface determination operation in S201, the candidate identifier unit 42 calculates the value of expression (4) by determining the inner product of the signal vectors of the left and right channels output from the stereo decoder unit 32. Depending on whether the value of expression (4) is zero or not, the candidate identifier unit 42 determines the surface shape of the error curved surface.

In S202, the candidate identifier unit 42 determines whether the surface shape of the error curved surface determined in the error curved surface determination operation in S201 is parabolic or not. If the surface shape of the error curved surface determined in the error curved surface determination operation in S201 is parabolic (yes branch from S202), the candidate identifier unit 42 proceeds to S203. The candidate extractor unit 22 then performs an operation to extract data. On the other hand, if the surface shape of the error curved surface determined in the error curved surface determination operation in S201 is not parabolic (ellipsoidal) (no branch from S202), the candidate identifier unit 42 determines that no data has been embedded in the prediction coefficient, and then ends the control process of FIG. 9.

In S203, the candidate identifier unit 42 performs an error straight line estimation operation. In the error straight line estimation operation, the candidate identifier unit 42 estimates the error straight line determined by the candidate extractor unit 22 in the error straight line determination operation in S103 of FIG. 4. The error straight line estimation operation in S203 is the same operation as the error straight line determination operation in S103 of FIG. 4. In the error straight line estimation operation in S203, the candidate identifier unit 42 estimates the error straight line by substituting the stereo signals of the left and right channels output from the stereo decoder unit 32 for respective signal vectors on the right side of each of expressions (5), (6), and (7).

In S204, the candidate identifier unit 42 performs a prediction coefficient candidate estimation operation. In the prediction coefficient candidate estimation operation, the candidate identifier unit 42 estimates the candidate of the prediction coefficient extracted by the candidate extractor unit 22 in the prediction coefficient candidate extraction operation in S104 of FIG. 4, and extracts from the code book 41 the candidate of the prediction coefficient in accordance with the error straight line estimated in S203. The prediction coefficient candidate estimation operation in S204 is the same operation as the prediction coefficient candidate extraction operation in S104 of FIG. 4. In the prediction coefficient candidate estimation operation in S204, however, from among the points corresponding to the prediction coefficients stored on the code book 41, any point having the same and minimum distance to the error straight line is selected, and a combination of the prediction coefficients represented by the selected points is extracted. The combination of the extracted prediction coefficients becomes identification results of the candidates of the prediction coefficients by the candidate identifier unit 42.

The candidate identifier unit 42 performs the operations in S201 through S204 as the candidate identification process in S200. When the candidate identifier unit 42 completes the candidate identification process in S200, the data extractor unit 43 then performs a data extraction process in S210. In the data extraction process, the data extractor unit 43 extracts from the candidate of the prediction coefficient identified by the candidate identifier unit 42 the data embedded in the encoded data by the data embedding unit 23, in accordance with the data embedding rule used by the data embedding unit 23 in the data embedding.

The data extraction process is described further in detail. In S211, the data extractor unit 43 performs an embed capacity calculation operation. In the embed capacity calculation operation, the data extractor unit 43 calculates a size of data that may be embedded. The embed capacity calculation operation is the same operation as the embed capacity calculation operation performed by the data embedding unit 23 in S111 of FIG. 4.

In S212, the data extractor unit 43 performs an embed value attachment operation. In the embed value attachment operation, the data extractor unit 43 attaches an embed value to each of the candidates of the prediction coefficients extracted in the prediction coefficient candidate estimation operation in S204 in accordance with the same rule used by the data embedding unit 23 in the embed value attachment operation in S112 of FIG. 4.

In S213, the data embedding unit 23 performs an embed data extraction operation. In the embed data extraction operation, the data embedding unit 23 acquires an embed value attached in the embed value attachment operation in S212 in response to the prediction coefficient received from the separator unit 31, and buffers the values on a specific storage area in the order of acquisition as extraction results of the data embedded by the data embedding unit 23.

Figure 10:
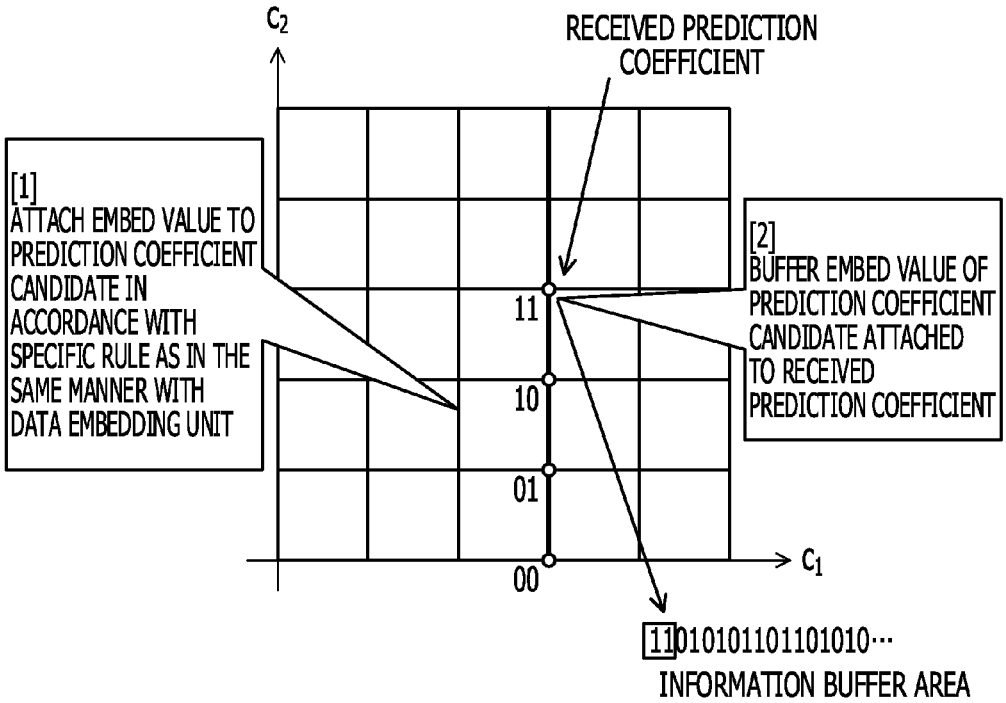
FIG. 10 illustrates a data extraction process.

The embed value attachment operation in S212 and the embed data extraction operation in S213 are specifically described with reference to FIG. 10. The candidates of the prediction coefficients may now be identified as illustrated in FIG. 7. The rule applied to the attachment of the embed value is the same rule as with the case of FIG. 8. In other words, the values are attached in the order of from small to large values to the prediction coefficients $c_2$. As illustrated in FIG. 10, embed values "00", "01", "10", and "11" are attached the blank circles in the order of from small to large values of the prediction coefficients $c_2$.

The prediction coefficient received from the separator unit 31 may now match a maximum value of the prediction coefficient $c_2$ among the blank circles, namely, the combination of the values of the point with the embed value "11" attached thereto. In such a case, the embed value "11" is extracted as the date embedded by the data embedding unit 23 and then buffered on an specific information buffer.

When the embed data extraction operation in S213 is complete, the control process of FIG. 9 ends. The data extractor device 40 performs the control process, thereby extracting the data embedded by the data embedding device 20.

Figure 11:
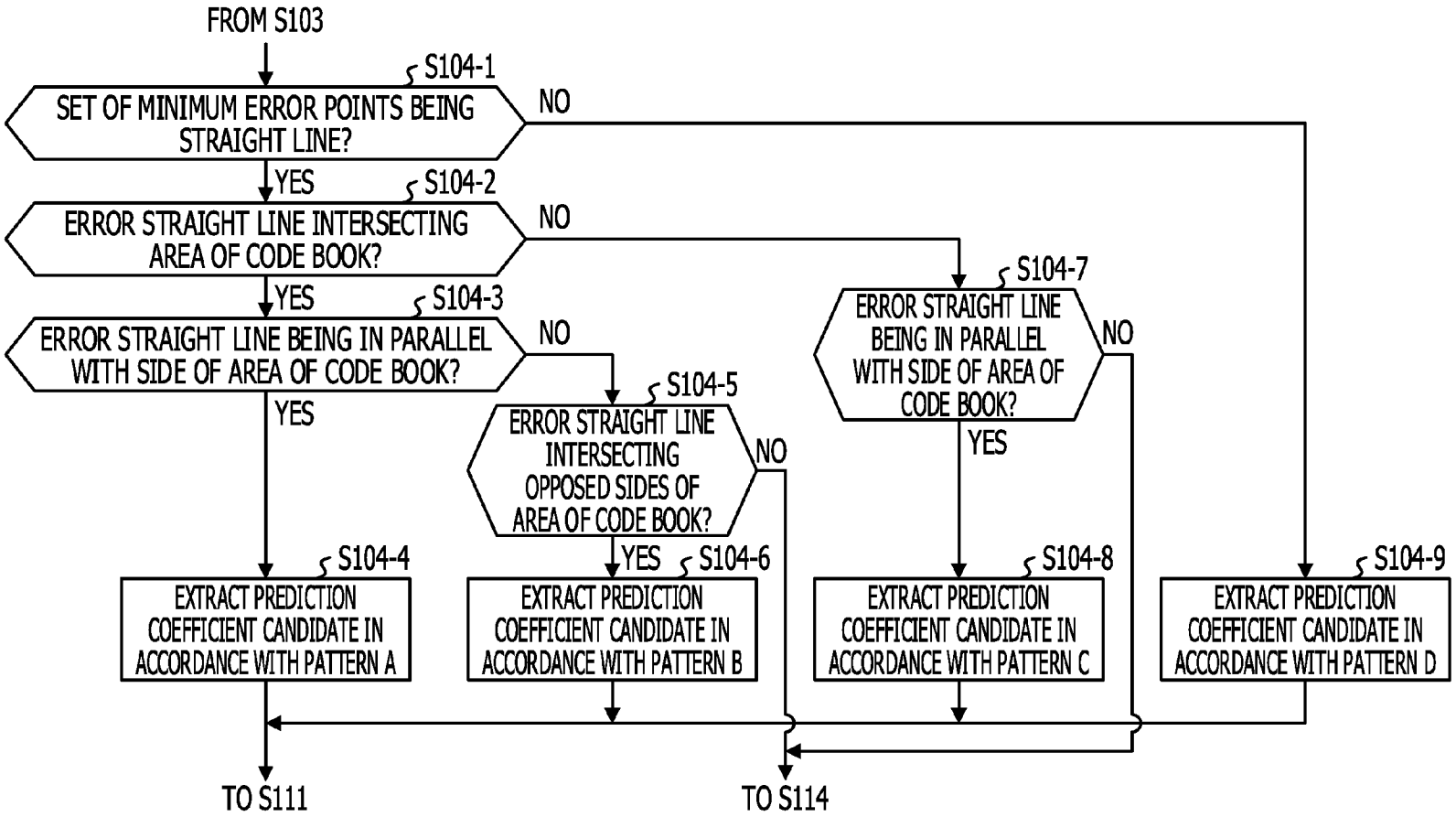
FIG. 11 is a flowchart illustrating a prediction coefficient candidate extraction process in detail.

FIG. 11 is described below. FIG. 11 is a flowchart illustrating the prediction coefficient candidate extraction operation in S104 of FIG. 4 in detail. In S104-1 subsequent to the error straight line determination operation in S103 of FIG. 4, the candidate extractor unit 22 performs an operation of determining whether a set of points, each point having a minimum error, becomes a straight line.

If both the r vector and the l vector are zero vectors as previously described, the set of points, each point having a minimum error, does not become a straight line. In the determination operation in S104-1, the candidate extractor unit 22 determines whether the set of points, each point having a minimum error, forms a straight line.

If the candidate extractor unit 22 determines in S104-1 that at least one of the r vector and the l vector is non-zero vector, and thus determines that the set of points forms a straight line (yes branch from S104-1), processing proceeds to S104-2. On the other hand, if the candidate extractor unit 22 determines in S104-1 that both the r vector and the l vector are zero vectors, and thus determines that the set of points does not form a straight line (no branch from S104-1), processing proceeds to S104-9.

In S104-2, the candidate extractor unit 22 whether the error straight line obtained through the error straight line determination operation in S103 of FIG. 4 intersects an area defined by the code book 21. The area defined by the code book 21 refers to an area of a rectangle circumscribing the points corresponding to the prediction coefficients stored on the code book 21 on the plane including the prediction coefficients $c_1$ and $c_2$. Upon determining that the error straight line intersects the area of the code book 21 (yes branch from S104-2), the candidate extractor unit 22 proceeds to S104-3. Upon determining that the error straight line does not intersect the area of the code book 21 (no branch from S104-2), the candidate extractor unit 22 proceeds to S104-7.

In S104-3, the candidate extractor unit 22 determines whether the error straight line is in parallel with one of the sides of the area of the code book 21. The sides of the area of the code book 21 refer to the sides of the rectangle determining the area of the code book 21. This determination operation proceeds to a yes branch if the error straight line is expressed by expression (5) or expression (6). On the other hand, if the error straight line is expressed by expression (7), in other words, if the ratio of the signal of the L channel to the signal of the R channel in magnitude remains constant for a specific period of time, the candidate extractor unit 22 determines that the error straight line is not in parallel with any of the sides of the area of the code book 21. This determination operation proceeds to no branch.

If the candidate extractor unit 22 determines in the determination operation in S104-3 that the error straight line is in parallel with one of the sides of the area of the code book 21 (yes branch from S104-3), processing proceeds to S104-4. If the candidate extractor unit 22 determines in the determination operation in S104-3 that the error straight line is in parallel with none of the sides of the area of the code book 21 (no branch from S104-3), processing proceeds to S104-5.

In S104-4, the candidate extractor unit 22 performs a prediction coefficient candidate extraction operation in accordance with a pattern A, and then proceeds to S111 of FIG. 4. The prediction coefficient candidate extraction operation of the pattern A is described below.

In S104-5, the candidate extractor unit 22 determines whether the error straight line intersects a pair of opposed sides of the area of the code book 21. Upon determining that the error straight line intersects the pair of opposed sides of the area of the code book 21 (yes branch from S104-5), the candidate extractor unit 22 proceeds to S104-6. In S104-6, the candidate extractor unit 22 performs the prediction coefficient candidate extraction operation in accordance with a pattern B. Processing then proceeds to S111 of FIG. 4. Upon determining that the error straight line does not intersect the pair of opposed sides of the area of the code book 21 (no branch from S104-5), the candidate extractor unit 22 proceeds to S114 of FIG. 4. The prediction coefficient candidate extraction operation of the pattern B is described below.

If the determination result in S104-2 is non-affirmative, a determination operation in S104-7 is performed. In S104-7, the candidate extractor unit 22 determines whether the error straight line is in parallel with a side of the area of the code book 21. This determination operation is identical to the determination operation in S104-3. Upon determining that the error straight line is in parallel with a side of the area of the code book 21 (yes branch from S104-7), the candidate extractor unit 22 proceeds to S104-8. In S104-8, the candidate extractor unit 22 performs the prediction coefficient candidate extraction operation in accordance with a pattern C, and then proceeds to S111 of FIG. 4. Upon determining that the error straight line is not in parallel with a side of the area of the code book 21 (no branch from S104-7), the candidate extractor unit 22 proceeds to S114 of FIG. 4. The prediction coefficient candidate extraction operation of the pattern C is described in detail below.

If the determination result in S104-1 is non-affirmative, the candidate extractor unit 22 performs the prediction coefficient candidate extraction operation in accordance with a pattern D in S104-9. Processing then proceeds to S111 of FIG. 4. The prediction coefficient candidate extraction operation of the pattern D is described below. The prediction coefficient candidate extraction process of FIG. 11 is performed in this way.

The prediction coefficient candidate extraction operation of each pattern is described below. The prediction coefficient candidate extraction operation of the pattern A performed in S104-4 is described first. In the pattern A, the error straight line intersects the area of the code book 21, and is in parallel with any of the sides of the area of the code book 21.

The pattern A refers to the case in which the error straight line has the positional relationship of FIG. 7 with the sides of the area of the code book 21. In the positional relationship of FIG. 7, the error straight line is in parallel with the sides parallel with the c2 axis out of the sides of the area of the code book 21. In such a case, the candidate extractor unit 22 extracts, as the candidate of the prediction coefficient, points having a minimum and the same distance to the error straight line out of the points corresponding to the prediction coefficients of the code book 21. As illustrated in FIG. 7, the points denoted by the blank circles out of the points corresponding to the prediction coefficients of the code book 21 are present on the error straight line. The points having a zero distance to the error straight line are thus extracted as the candidates of prediction coefficients.

The pattern B handled in the operation in S104-6 is described with reference to FIGS. 12A and 12B. In the pattern B, the error straight line is in parallel with none of the sides of the area of the code book 21 but intersects the pair of opposed sides of the area of the code book 21.

Figure 12A:
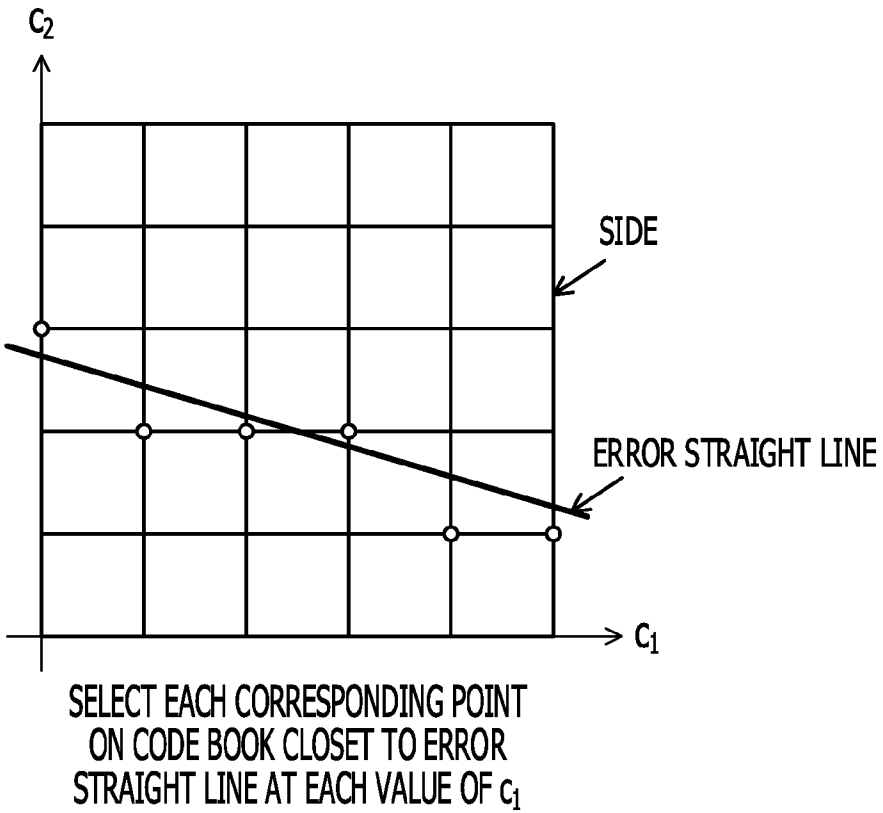
FIGS. 12A and 12B illustrate a prediction coefficient candidate extraction process of a pattern B.
Figure 12B:
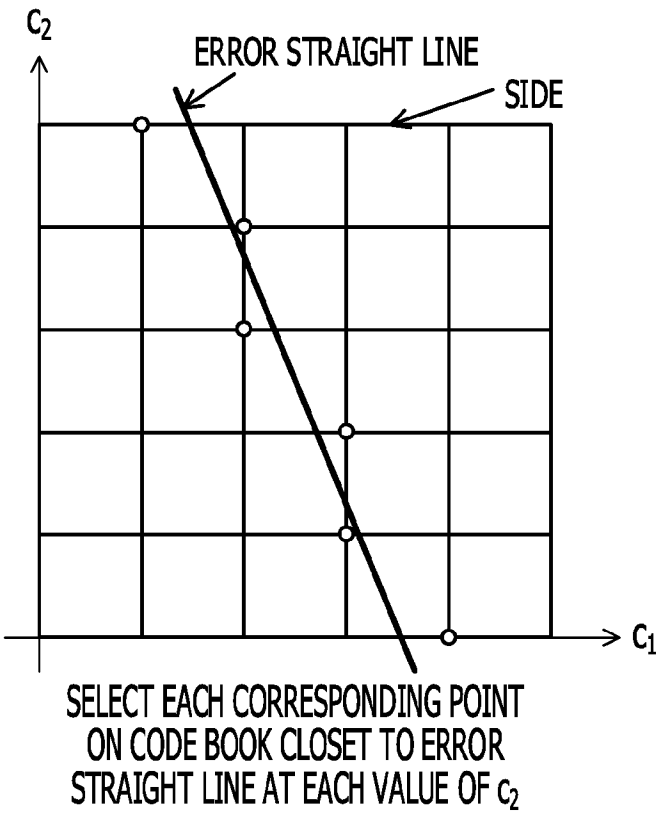

FIGS. 12A and 12B illustrate the points corresponding to the prediction coefficients stored on the code book 21 on the two-dimensional orthogonal coordinates defined by the prediction coefficients $c_1$ and $c_2$. The points arranged as grid points are the same as those illustrated in FIG. 7.

FIG. 12A illustrates the error straight line that intersects the pair of opposed sides of the area parallel with the $c_2$ axis out of the pairs of sides of the area of the code book 21. In this case, the corresponding point on the code book 21 closest to the error straight line in terms of each value of the prediction coefficient $c_1$ on the code book 21 is extracted as the candidate of prediction coefficient. The candidate of prediction coefficient thus extracted with respect to the value of the prediction coefficient $c_1$ corresponds to the value of the prediction coefficient $c_2$ having a minimum predictive error if the signal of the center channel is predicted.

FIG. 12B illustrates the error straight line that intersects the pair of opposed sides of the area parallel with the $c_1$ axis out of the pairs of sides of the area of the code book 21. In this case, the corresponding point on the code book 21 closest to the error straight line in terms of each value of the prediction coefficient $c_2$ on the code book 21 is extracted as the candidate of prediction coefficient. The candidate of prediction coefficient thus extracted with respect to the value of the prediction coefficient $c_2$ corresponds the value of the prediction coefficient $c_1$ having a minimum predictive error if the signal of the center channel is predicted.

Summarizing the cases illustrated in FIGS. 12A and 12B, the grid point closest to the error straight line is selected from among the grid points present on the pair of opposed sides of the area that the error straight line intersects, and the prediction coefficient corresponding to the selected grid point is extracted as a candidate of prediction coefficient. The grid point closest to the error straight line is selected from among the grid points present on line segments passing through grid points and parallel with the pair of opposed sides of the area that the error straight line intersects, and the prediction coefficient corresponding to the selected grid point is extracted as a candidate of prediction coefficient.

More specifically, the prediction coefficient candidate extraction operation of the pattern B of the candidate extractor unit 22 may also be described as below.

Figure 13:
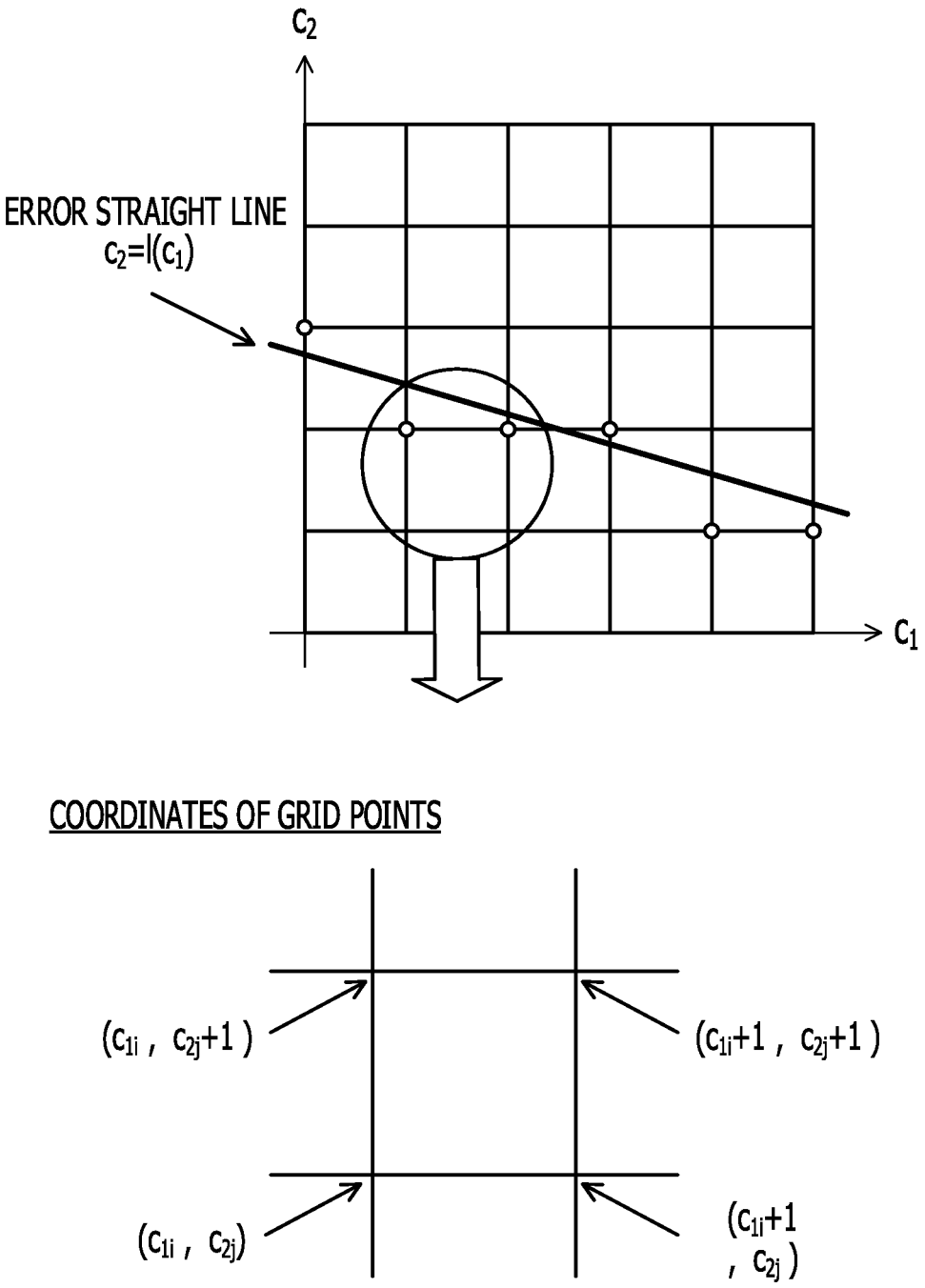
FIG. 13 illustrates a specific process example of the prediction coefficient candidate extraction process of the pattern B.

FIG. 13 illustrates the case of FIG. 12A more in detail. The error straight line may now be expressed by $c_2=l\times c_1$. Four adjacent coordinates from among the grid points of the code book 21 are defined as illustrated in FIG. 13.

The following steps (a) and (b) are performed with the value of a variable i incremented by 1.

(a) $c2_j$ and $c2_{j+1}$ satisfying $c2_j \le l\times c1_j \le c2_{j+1}$ are determined.

(b) The candidate of prediction coefficient is extracted from the code book 21 depending on whether one of conditions (i) and (ii) is satisfied.

(i) If condition $|c2_j - l\times c1_i| \le |c2_{j+1} - l\times c1_i|$ is satisfied, the prediction coefficient corresponding to a grid point ($c1_i$, $c2_{j+1}$) is extracted from the code book 21.

(ii) If condition $|c2_j - l \times c1_i| \leq |c2_{j+1} - l \times c1_i|$ is satisfied, the prediction coefficient corresponding to a grid point ($c1_i$, $c2_{j+1}$) is extracted as a candidate from the code book 21.

The prediction coefficient candidate extraction operation of the pattern C performed in S104-8 is described with reference to FIGS. 14A and 14B. In the pattern C, the error straight line does not intersect the area of the code book 21 but is parallel with one of the sides of the area of the code book 21.

Figure 14A:
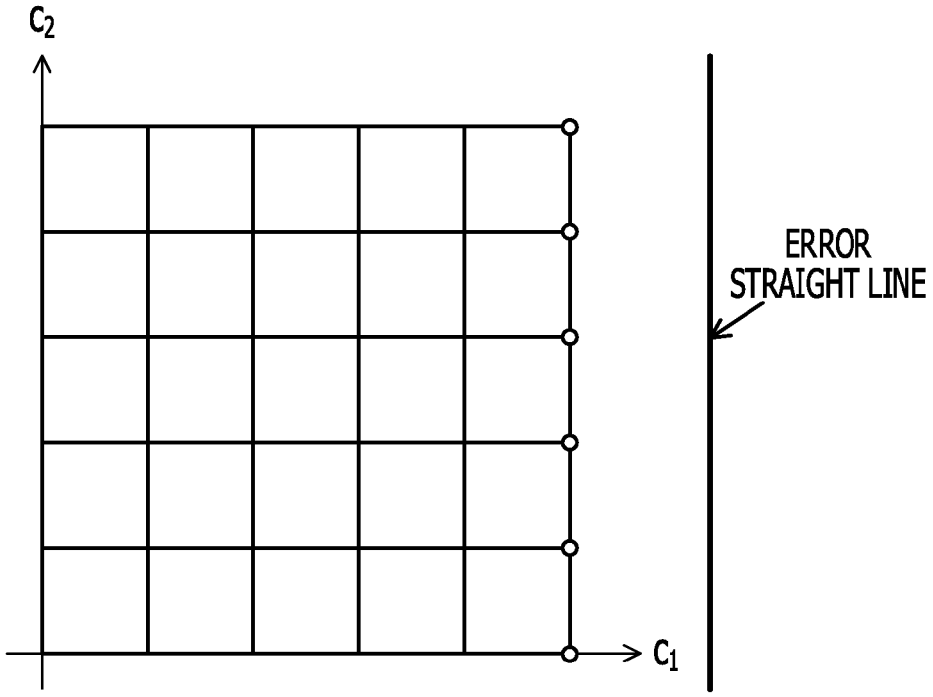
FIGS. 14A and 14B illustrate the prediction coefficient candidate extraction process of a pattern C.
Figure 14B:
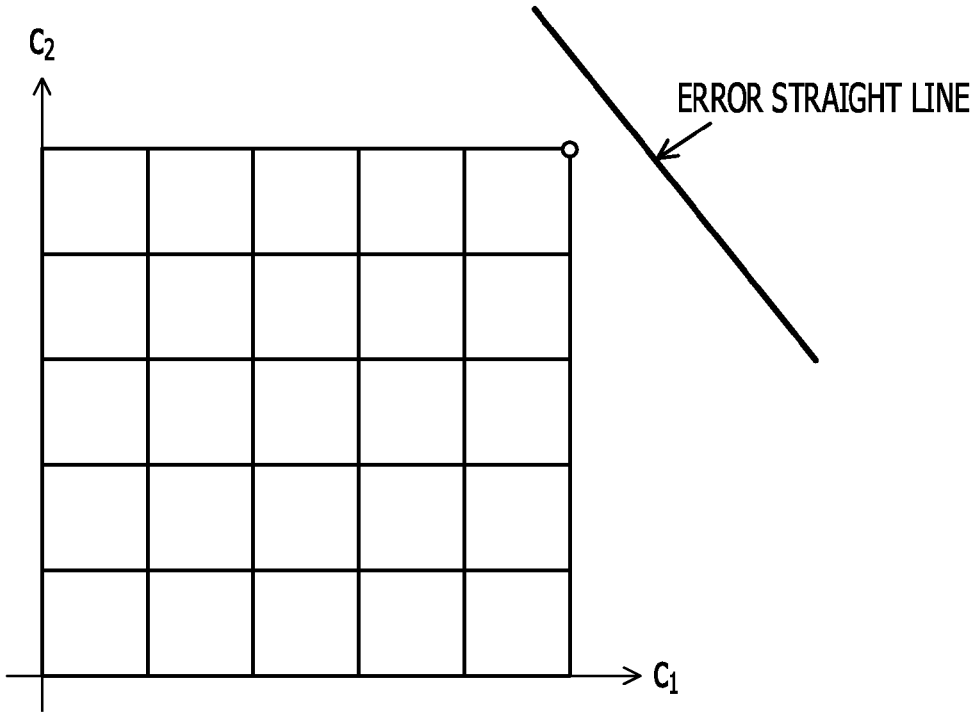

FIGS. 14A and 14B illustrate the points corresponding to the prediction coefficients stored on the code book 21 on the two-dimensional orthogonal coordinates defined by the prediction coefficients $c_1$ and $c_2$. The points arranged as grid points are the same as those illustrated in FIG. 7.

FIG. 14A illustrates the pattern C in which the error straight line does not intersects the area of the code book 21 and is in parallel with the sides of the area parallel with the $c_2$ axis. In this case, the points on the code book 21 on the side closest to the error straight line from among the sides of the area of the code book 21 are extracted as the candidates of prediction coefficients. If the signal of the center channel is predicted using any of the prediction coefficients thus extracted, the predictive error remains the same.

FIG. 14B illustrates the case in which the pattern C is not applicable. The error straight line is not parallel with any of the sides of the area of the code book 21. As illustrated in FIG. 14B, if the signal of the center channel is predicted using the prediction coefficient corresponding to the point denoted by a blank circle out of the points of the code book 21, the predictive error becomes a minimum. If the other parameters are used, the predictive error increases. In this case, the additional data is not embedded in the prediction coefficient in the present embodiment.

The prediction coefficient candidate extraction operation of the pattern D performed in S104-9 is described with reference to FIG. 15. In the pattern D, both the signal of the R channel and the signal of the L channel are zeros, and the error straight line is not determined in the error straight line determination operation in S103.

Figure 15:
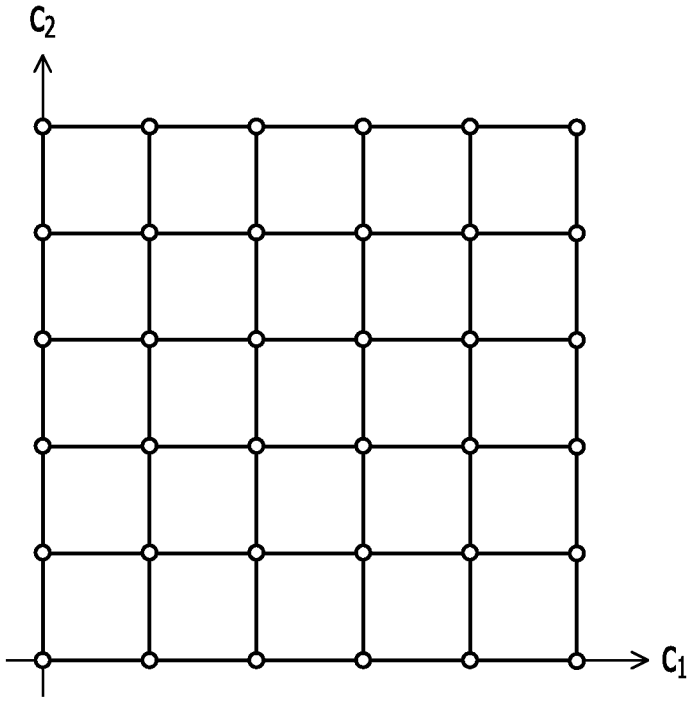
FIG. 15 illustrates the prediction coefficient candidate extraction process of a pattern D.

FIG. 15 illustrates the points corresponding to the prediction coefficients stored on the code book 21 on the two-dimensional orthogonal coordinates defined by the prediction coefficients $c_1$ and $c_2$. The points arranged as grid points are the same as those illustrated in FIG. 7. The signal of the center channel becomes zero regardless of which prediction coefficient is selected in the prediction of the center channel through expression (1). In this case, all the prediction coefficients stored on the code book 21 are extracted as candidates.

The candidate extractor unit 22 thus uses a prediction coefficient candidate extraction operation of a different pattern depending on the positional relationship between the error straight line and the area of the code book 21, and extracts the prediction coefficient candidates. In the prediction coefficient candidate estimation operation in S204 of FIG. 9, the candidate identifier unit 42 performs the same operation as the prediction coefficient candidate extraction operation described above.

The embedding of the additional data, different from the embed target data, by the data embedding device 20 is described below. The data to be embedded into the prediction coefficient by the data embedding device 20 may be any type of data. By embedding the additional data indicating a leading position of the embed target data, the data extractor device 40 may easily find the head of the embed target data from the extracted data. By embedding the additional data indicating a trailing position of the embed target data, the data extractor device 40 may easily find the trail of the embed target data from the extracted data.

Techniques of embedding the additional data separate from the embed target data is described below. In a first technique, the data embedding unit 23 attaches, to the leading end or the trailing end of the embed target data, additional data that represents the presence of the embed target data and the leading end or the trailing end of the embed target data. The first technique is described with reference to FIGS. 16A through 16C.

FIG. 16A illustrates the embed target data as "11010 10 . . . 01010".

In FIG. 16B, a bit string "0001" is defined in advance as start data indicating the presence of and the head of the embed target data, and a bit string "1000" is defined in advance as end data indicating the trailing end of the embed target data. It is noted that none of these bit strings appear in the embed target data. For example, three consecutive zeros do not appear in the embed target data. In the prediction coefficient candidate extraction operation in S113 of FIG. 4, the data embedding unit 23 attaches the start data immediately prior to the embed target data and the end data immediately subsequent to the embed target data. The data embedding unit 23 references a bit string of an embed capacity in the embed target data after the data embedding, and selects the candidate of the prediction coefficient to which an embed value matching the bit string is attached. The data extractor unit 43 in the data extractor device 40 excludes the start data and the end data from the data extracted from the prediction coefficient in the embed data extraction operation in S213 of FIG. 9, and then outputs the remaining data.

FIG. 16C illustrates the case in which a bit string "01111110" is defined in advance as start and end data indicating the presence of the embed target data and the leading end or the trailing end of the embed target data. It is noted that this bit string does not appear in the embed target data. For example, six consecutive zeros do not appear in the embed target data. In the prediction coefficient selection operation in S113 of FIG. 4, the data embedding unit 23 attaches the start and end data immediately prior to the embed target data and immediately subsequent to the embed target data, respectively. The data embedding unit 23 references a bit string of an embed capacity in the embed target data after the data embedding, and selects the candidate of the prediction coefficient to which an embed value matching the bit string is attached. The data extractor unit 43 in the data extractor device 40 excludes the start data and end data from the data extracted from the prediction coefficient in the embed extraction operation in S213 of FIG. 9, and then outputs the remaining data.

A second technique of embedding the additional data different from the embed target data is described. In the second technique, the data embedding unit 23 embeds the additional data together with the embed target data in the prediction coefficient by selecting from the extracted candidates the prediction coefficient as a resulting of the predictive encoding in accordance with the specific data embedding rule.

If the candidates of prediction coefficients extracted by the candidate extractor unit 22 are extracted as denoted by the blank circles in FIG. 7, the data embedding unit 23 may attach the embed values to the candidates in the embed value attachment operation thereof. The embed values are respectively attached to four blank circles out of the six blank circles in FIG. 7, but the remaining two blank circles are not used in the data embedding. In the second technique, the candidates of prediction coefficients unused in the embedding of the embed target data are used to embed the additional data.

Figure 17:
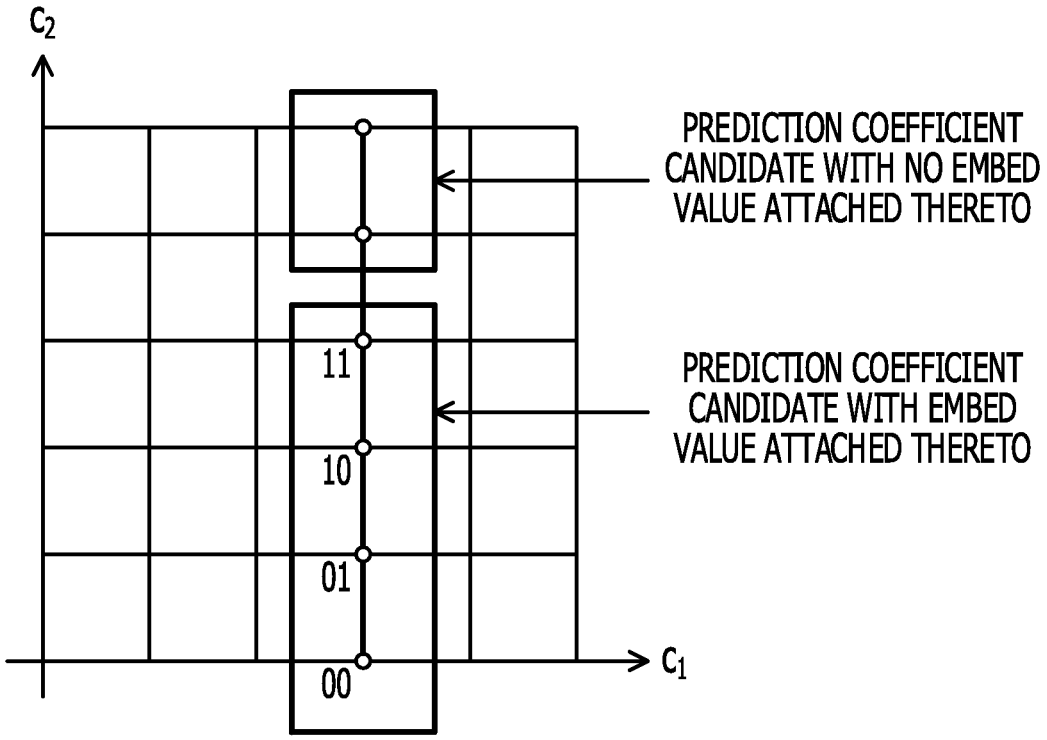
FIG. 17 illustrates a second technique of embedding the additional data.

More specifically, as illustrated in FIG. 17, one of the two blank circles unused for embedding the embed target data, for example, the one blank circle having the smaller value of the prediction coefficient $c_2$ is assigned in advance to the presence and start of the embed target data. The other blank circle having the larger value of the prediction coefficient $c_2$ is assigned in advance to the end of the embed target data. In the prediction coefficient selection operation in S113 of FIG. 4, the data embedding unit 23 first selects the candidate of the prediction coefficient assigned to the "start of the embed target data", and then successively selects the candidates of the prediction coefficients in accordance with the relationship between the embed target data and the embed value. Upon selecting the candidates of the prediction coefficients in response to the embed target data, the data embedding unit 23 selects the candidate of the prediction coefficient assigned to the "end of the embed target data".

In the embed data extraction operation in S213 of FIG. 9, the data extractor unit 43 in the data extractor device 40 outputs the data extracted from the prediction coefficient between the prediction coefficients respectively assigned to the start and end of the embed target data.

A third technique of embedding the additional parameter different from the embed target data is described below. As previously described, the processes of the function blocks of the data embedding device 20 are performed on each of the frequency component signals of the band segments into which one channel audio frequency band is divided. More specifically, the candidate extractor unit 22 extracts from the code book 21 a plurality of candidates of prediction coefficients from each of the frequency bands, each candidate falling having within a specific threshold value an error with the prediction coefficient obtained on each frequency band in the predictive encoding on each frequency band of the center channel. In the third technique, the data embedding unit 23 embeds the embed target data in a prediction coefficient by selecting the prediction coefficient as a result of the predictive encoding of a first frequency band from the candidates extracted from the first frequency band. The data embedding unit 23 embeds the additional data in a prediction coefficient by selecting the prediction coefficient as a result of the predictive encoding of a second frequency band different from the first frequency band from the candidates extracted from the second frequency band.

The third technique of embedding the additional data is described with reference to FIG. 18. In the third technique, from among the candidates of the prediction coefficients obtained from each of six frequency bands of the audio signal on a per frame basis, three candidates in a low-frequency region are used to embed the embed target data, and three candidates in a high-frequency region are used to embed the additional data. The additional data in this case may contain data representing the presence of the embed target data and the start or the end of the embed target data in the same manner as in the first and second techniques.

Figure 18:
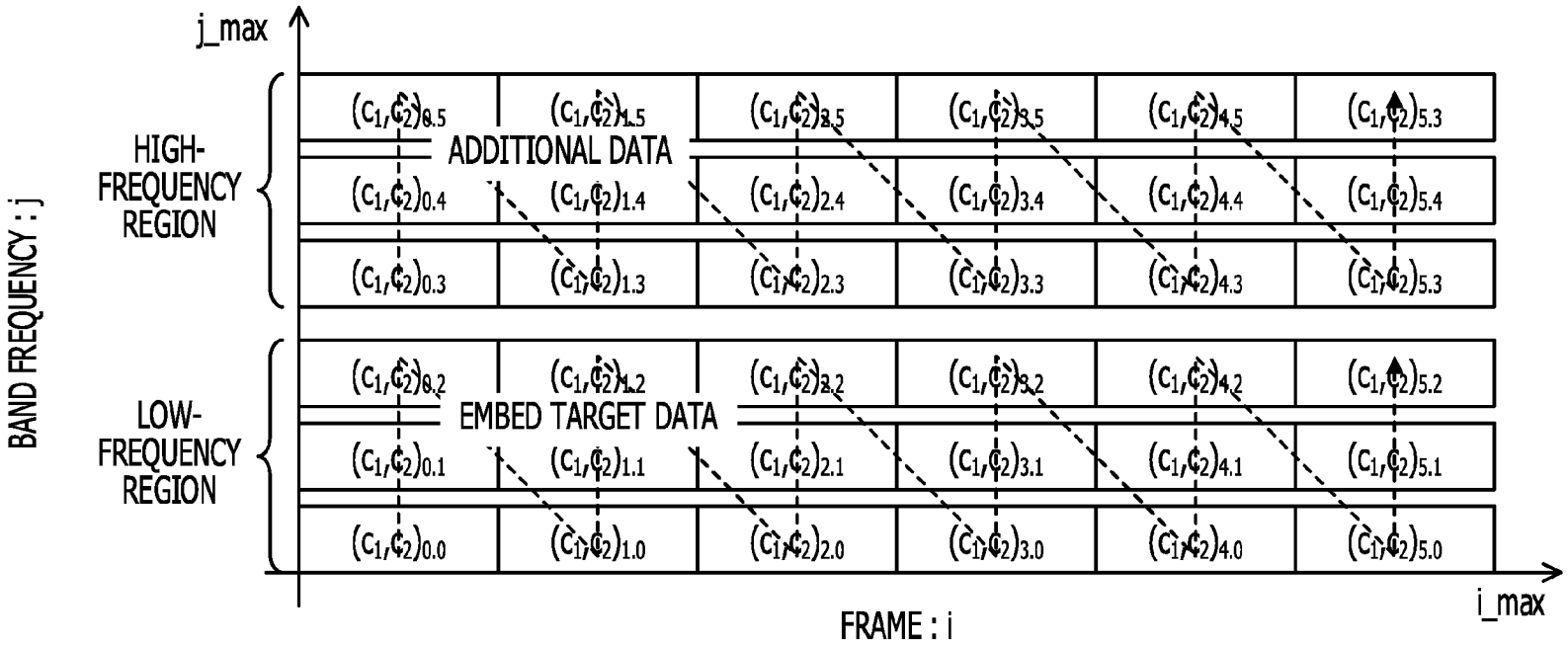
FIG. 18 illustrates a third technique of embedding the additional data.

In FIG. 18, a variable i is an integer falling within a range of from zero or larger to i_max or smaller, and represents a number to be attached to each frame in the order of time sequence. A variable j is an integer falling within a range of from zero or larger to j_max or smaller, and represents a number to be attached to each frequency band in the order of low to high frequency. As illustrated in FIG. 18, each of a constant i_max and a constant j_max has a value "5", and $(c_1, c_2)_{i,j}$, represents a prediction coefficient in an i-th frame of a j-th frequency band.

Figure 19:
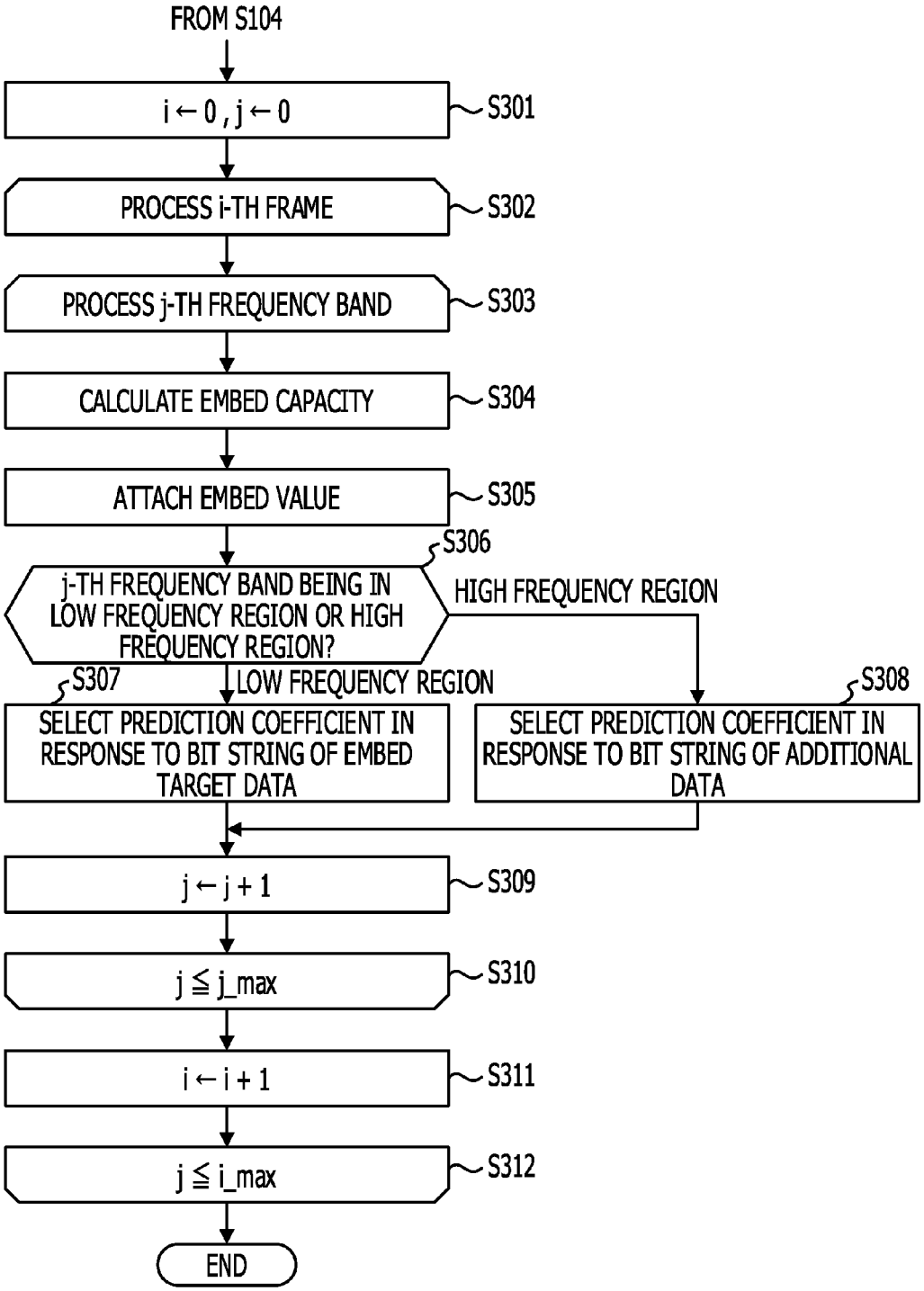
FIG. 19 is a flowchart illustrating a modification of the control process of the data embedding device.

FIG. 19 is described next. FIG. 19 is a flowchart illustrating a modification of the control process of the data embedding device 20. The process represented by the flowchart is preformed to embed the embed target data and the additional data as illustrated in FIG. 18. The data embedding unit 23 performs this data embedding process as S110 subsequent to S104 in the flowchart of FIG. 4.

Subsequent to S104 of FIG. 4, the data embedding unit 23 substitutes "0" for the variable i and the variable j in S301. After S301, S302, paired with S312, forms a loop. The data embedding unit 23 iterates steps in S303 through S311 with the value of the variable i.

Step S303, paired with step S310, forms a loop. The data embedding unit 23 iterates steps in S304 through S309 with the value of the variable j.

In S304, the data embedding unit 23 performs an embed capacity calculation operation. In the embed capacity calculation operation in S304 identical to the embed capacity calculation operation in S111 of FIG. 4, the data embedding unit 23 calculates a size of data that is allowed to be embedded using the candidate of the prediction coefficient of the i-th frame of the j-th frequency band.

In S305, the data embedding unit 23 performs an embed value attachment operation. In the embed value attachment operation in S305, identical to the embed value attachment operation in S112 of FIG. 4, the data embedding unit 23 attaches an embed value to each of the candidates of the prediction coefficients at the i-th frame of the j-th frequency band in accordance with the specific rule.

In S306, the data embedding unit 23 performs a determination operation as to whether the j-th frequency band belongs to the low-frequency region or the high-frequency region. Upon determining that the j-th frequency band belongs to the low-frequency region, the data embedding unit 23 proceeds to S307. Upon determining that the j-th frequency band belongs to the high-frequency region, the data embedding unit 23 proceeds to S308.

In S307, the data embedding unit 23 performs a prediction coefficient selection operation responsive to a bit string of the embed target data, and then proceeds to S309. In the prediction coefficient selection operation in S307, the data embedding unit 23 references the bit string of the embed capacity in the embed target data, and selects the candidate of the prediction coefficient with the embed value matching the value of the bit string from the candidates of the prediction coefficients at the i-th frame of the j-th frequency band. The prediction coefficient selection operation in S307 is identical to the prediction coefficient selection operation in S113 of FIG. 4.

In S308, the data embedding unit 23 performs a prediction coefficient selection operation responsive to a bit string of the additional data, and then proceeds to S309. In the prediction coefficient selection operation in S308, the data embedding unit 23 references the bit string of the embed capacity in the additional data, and selects the candidate of the prediction coefficient with the embed value matching the value of the bit string from the candidates of the prediction coefficients at the i-th frame of the j-th frequency band. The prediction coefficient selection operation in S308 is also identical to the prediction coefficient selection operation in S113 of FIG. 4.

In S309, the data embedding unit 23 substitutes the sum resulting from adding "1" to the current value of the variable j for the variable j. In S310, the data embedding unit 23 determines whether the loop starting with S303 is to be iterated. Upon determining that the value of the variable j is the constant j_max or smaller, the data embedding unit 23 iterates operations in S304 through S309. Upon determining that the value of the variable j is above the constant j_max, the data embedding unit 23 terminates the iteration of operations in S304 through S309, and then proceeds to S311.

In S311, the data embedding unit 23 substitutes the sum resulting from adding "1" to the current value of the variable i for the variable i. In S312, the data embedding unit 23 determines whether the loop starting with S302 is to be iterated. Upon determining that the value of the variable i is the constant i_max or smaller, the data embedding unit 23 iterates operations in S303 through S311. Upon determining that the value of the variable i is above the constant i_max, the data embedding unit 23 terminates the iteration of operations in S303 through S311, and then terminates the control process.

Through the control process, the data embedding device 20 embeds the embed target data and the additional data as illustrated in FIG. 18 in the prediction coefficients. In the data extraction process in S210 of FIG. 9, the data extractor unit 43 in the data extractor device 40 performs the control process of FIG. 19, thereby extracting the embed target data and the additional data.

In the first through third techniques described above to embed the target data and the additional data, the additional data indicates the presence of the embed target data and the start or the end of the embed target data. Different data may be embedded in the prediction coefficient. For example, if the embed target data is error correction encoded data, the additional data to be embedded in the prediction coefficient may indicate whether the embed target data has been error correction encoded or not. The error correction encoding method may be something simple like the one illustrated in FIGS. 20A through 20D.

FIG. 20A illustrates original data prior to an error correction encoding operation. The error correction encoding operation is to output the value of each bit of the original data three times consecutively. FIG. 20B illustrates the resulting data obtained by performing the error correction encoding operation on the original data of FIG. 20A. The data embedding device 20 embeds the data of FIG. 20B as the embed target data in the prediction coefficient while also embedding, as the additional data, data indicating whether the error correction encoding operation has been performed on the embed target data.

FIG. 20C illustrates the embed target data extracted by the data extractor device 40. The extracted data of FIG. 20C is partially different from the data of FIG. 20B. In order to restore the original data of FIG. 20A from the embed target data, the embed target data is divided into bit strings by every 3 bits in the order of arrangement, and a majority operation is performed on the values of the 3 bits included in each bit string. By arranging the results of the majority operation, corrected data of FIG. 20D results. The corrected data of FIG. 20D is found equal to the original data of FIG. 20A.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. A data embedding device comprising:

a memory which stores a plurality of candidate coefficients extracted from a plurality of prediction coefficients for predictive coding, each of the plurality of candidate coefficients having a predictive error that falls within a specific error range of predictive coding of a specified channel signal based on a plurality of other channel signals, each of the candidate coefficients being associated with each of a plurality of bit patterns; and a processor configured to:

obtain target audio data to be coded and a bit string to be embedded in the target audio data, the target audio data including the specified channel signal and the plurality of other channel signals, the target audio data being divided into one or more partial data, the bit string being divided into one or more partial bit strings, each of the plurality of candidate coefficients being associated with each of the plurality of bit patterns;

select one or more bit patterns that matches each of the one or more partial data, each of the one or more bit patterns being selected among from the plurality of bit patterns;

code the target audio data by coding each of the one or more partial data each of the one or more partial data being coded by using one or more candidate coefficients associated with each of the one or more selected bit patterns; and output the coded target audio data to a decoding device configured to extract the bit string from the target audio data based on the selected one or more bit patterns associated with the one or more candidate coefficients used in the coding.

2. The device according to claim 1, wherein the prediction coefficient contains a component of each of two of the plurality of other channel signals, and wherein the processor is further configured to:

extract the plurality of candidate coefficients from the plurality of prediction coefficients, the extracting comprises determining a straight line as a set of points, each point having a minimum predictive error on a plane that is defined by the two components of the two prediction coefficients, and extracting the candidate of prediction coefficient in accordance with a positional relationship between the straight line and points on the plane corresponding to the plurality of prediction coefficients.

3. The device according to claim 2, wherein the extracting comprises extracting a plurality of prediction coefficients having points on the plane corresponding to a plurality of points on the straight line.

4. The device according to claim 2, wherein the extracting comprises determining whether the set of points, each point having a minimum predictive error, forms a straight line on the plane, and if the set of points is determined to form the straight line, extracting the candidate of the prediction coefficient in accordance with the positional relationship.

5. The device according to claim 4, wherein the determining involves using an inner product of signal vectors of the two other channel signals.

6. The device according to claim 4, wherein the plane is a plane of an orthogonal coordinate system, and has the two components of the prediction coefficient respectively in directions of two coordinate axes;

wherein the plurality of prediction coefficients is preset so that the points corresponding to the candidates on the plane are arranged as grid points in an area enclosed by a rectangle having sides respectively parallel with the direction of the coordinate axes on the plane;

wherein if the set of points, each point having a minimum predictive error, is determined to form the straight line on the plane, the extracting comprises determining whether the straight line intersects two opposed sides of the rectangle on the plane, and if the straight line is determined to intersect the two opposed sides of the rectangle on the plane, the extracting comprises extracting a prediction coefficient corresponding to a grid point closest to the straight line out of the grip points present in the two opposed sides, and extracting a prediction coefficient corresponding to a grid point closest to the straight line out of grid points present on line segments passing through the grid points and extending within the rectangle in parallel with the two opposed sides of the rectangle.

7. The device according to claim 6, wherein the extracting comprises determining whether a ratio of the two other channel signals in magnitude remains constant for a specific period of time, and if the ratio of the two other channel signals in magnitude is determined to remain constant for the specific period of time, the extracting comprises determining that the straight line intersects one of the sides of the rectangle on the plane.

8. The device according to claim 6, wherein if the straight line is determined not to intersect the two opposed sides of the rectangle on the plane, the extracting comprises determining whether the straight line is in parallel with one of the sides of the rectangle, and if the straight line is determined to be in parallel with one of the sides of the rectangle, the extracting comprises extracting a candidate of a prediction coefficient corresponding to a grid point present on a side closest to the straight line out of the sides of the rectangle.

9. The device according to claim 2, wherein the extracting comprises determining whether the two other channel signals are zero in magnitude, and if the two other channel signals are determined to be zero in magnitude, the extracting comprises extracting all the prediction coefficients stored on the code book.

10. The device according to claim 2, wherein the processor is further configured to:

embed additional data in the target audio data, different from the bit string, together with the bit string, wherein the bit string is available to be generated by uniting the plurality of bit patterns in prescribed order, and wherein the bit string is embedded in the target audio data by using the plurality of candidate coefficients corresponding to bit patterns to be united in the prescribed order.

11. The device according to claim 10, wherein the embedding comprises attaching the additional data to a leading end or a trailing end of the bit string, and embedding the bit string with the additional data attached thereto, the additional data being a bit string different from the bit string.

12. The device according to claim 10, wherein the extracting comprises extracting a plurality of candidates of prediction coefficients of a channel signal on each frequency band, each candidate having within a specific threshold value an error with a prediction coefficient obtained on a per frequency band through predictive encoding of two other channel signals on each frequency band; and wherein the embedding comprises embedding the bit string in a prediction coefficient by selecting the prediction coefficient as a result of the predictive encoding in a first frequency band from the candidates extracted from the first frequency band, and embedding the additional data into a prediction coefficient by selecting the prediction coefficient as a result of the predictive encoding in a second frequency band different from the first frequency band from the candidates extracted from the second frequency band.

13. The device according to claim 10, wherein the additional data indicates a presence or absence of embedding of the embedded target audio data in the prediction coefficient.

14. The device according to claim 10, wherein the additional data indicates whether error correction encoding has been performed on the bit string.

15. A data embedding method comprising:

storing a plurality of candidate coefficients extracted from a plurality of prediction coefficients for predictive coding in a memory, each of the plurality of candidate coefficients having a predictive error that falls within a specific error range of predictive coding of a specified channel signal based on a plurality of other channel signals, each of the candidate coefficients being associated with each of a plurality of bit patterns;

obtaining target audio data to be coded and a bit string to be embedded in the target audio data, the target audio data including the specified channel signal and the plurality of other channel signals, the target audio data being divided into one or more partial data, the bit string being divided into one or more partial bit strings, each of the plurality of candidate coefficients being associated with each of the plurality of bit patterns;

selecting one or more bit patterns that matches each of the one or more partial data, each of the one or more bit patterns being selected among from the plurality of bit patterns;

coding the target audio data by coding each of the one or more partial data each of the one or more partial data being coded by using one or more candidate coefficients associated with each of the one or more selected bit patterns; and outputting the coded target audio data to a decoding device configured to extract the bit string from the target audio data based on the selected one or more bit patterns associated with the one or more candidate coefficients used in the coding.

16. A non-transitory computer-readable storage medium storing a data embedding program that causes a computer to execute a process, the processing comprising:

storing a plurality of candidate coefficients extracted from a plurality of prediction coefficients for predictive coding in a memory, each of the plurality of candidate coefficients having a predictive error that falls within a specific error range of predictive coding of a specified channel signal based on a plurality of other channel signals, each of the candidate coefficients being associated with each of a plurality of bit patterns;

obtaining target audio data to be coded and a bit string to be embedded in the target audio data, the target audio data including the specified channel signal and the plurality of other channel signals, the target audio data being divided into one or more partial data, the bit string being divided into one or more partial bit strings, each of the plurality of candidate coefficients being associated with each of the plurality of bit patterns;

selecting one or more bit patterns that matches each of the one or more partial data, each of the one or more bit patterns being selected among from the plurality of bit patterns;

coding the target audio data by coding each of the one or more partial data each of the one or more partial data being coded by using one or more candidate coefficients associated with each of the one or more selected bit patterns; and outputting the coded target audio data to a decoding device configured to extract the bit string from the target audio data based on the selected one or more bit patterns associated with the one or more candidate coefficients used in the coding.

17. A non-transitory data extractor device comprising:

a memory which stores a plurality of candidate coefficients extracted from a plurality of prediction coefficients for predictive coding, each of the plurality of candidate coefficients having a predictive error that falls within a specific error range of predictive coding of a specified channel signal based on a plurality of other channel signals, each of the candidate coefficients being associated with each of a plurality of bit patterns; and a processor configured to:

receive a coded target audio data that is generated by coding a target audio data by using the plurality of candidate coefficients, the coded target audio data including one or more partial data, each of the one or more partial data being coded by using each of the plurality of candidate coefficients, the target audio data including the specified channel signal and the plurality of other channel signals, the target audio data being divided into one or more partial data, a bit string being divided into one or more partial bit strings, each of the plurality of candidate coefficients being associated with each of the plurality of bit patterns;

identify one or more bit patterns that matches each of the one or more partial data, each of the one or more bit patterns being selected among from the plurality of bit patterns used in coding, each of the one or more partial data being coded by using one or more candidate coefficients associated with each of the one or more selected bit patterns; and obtain a bit string embedded in the coded target audio data based on the plurality of identified bit patterns.

18. A data extraction method to extract data in a prediction coefficient, the data extraction method comprising:

storing a plurality of candidate coefficients extracted from a plurality of prediction coefficients for predictive coding in a memory, each of the plurality of candidate coefficients having a predictive error that falls within a specific error range of predictive coding of a specified channel signal based on a plurality of other channel signals, each of the candidate coefficients being associated with each of a plurality of bit patterns;

obtaining target audio data to be coded and a bit string to be embedded in the target audio data, the target audio data including the specified channel signal and the plurality of other channel signals, the target audio data being divided into one or more partial data, the bit string being divided into one or more partial bit strings, each of the plurality of candidate coefficients being associated with each of the plurality of bit patterns;

selecting one or more bit patterns that matches each of the one or more partial data, each of the one or more bit patterns being selected among from the plurality of bit patterns;

coding the target audio data by coding each of the one or more partial data each of the one or more partial data being coded by using one or more candidate coefficients associated with each of the one or more selected bit patterns; and outputting the coded target audio data to a decoding device configured to extract the bit string from the target audio data based on the selected one or more bit patterns associated with the one or more candidate coefficients used in the coding.

* * * * *